US006633260B2

(12) United States Patent
Paschen et al.

(10) Patent No.: US 6,633,260 B2
(45) Date of Patent: Oct. 14, 2003

(54) ELECTROMECHANICAL SWITCHING FOR CIRCUITS CONSTRUCTED WITH FLEXIBLE MATERIALS

(75) Inventors: Dean A. Paschen, Lafayette, CO (US); P. Keith Kelly, Lakewood, CO (US); Dan A. Payne, Morrison, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/972,551

(22) Filed: Oct. 5, 2001

(65) Prior Publication Data

US 2003/0067411 A1 Apr. 10, 2003

(51) Int. Cl.[7] ..... H01Q 1/38

(52) U.S. Cl. ..... 343/700 MS; 343/770; 343/876

(58) Field of Search ..... 343/700 MS, 850, 343/853, 876, 770, 893, 746

(56) References Cited

U.S. PATENT DOCUMENTS

| | | | | |
|---|---|---|---|---|
| 4,516,091 A | | 5/1985 | Sasser | 333/161 |
| 4,768,001 A | | 8/1988 | Chan-Son-Lint et al. | 333/159 |
| 5,387,888 A | * | 2/1995 | Eda et al. | 333/247 |
| 5,619,061 A | | 4/1997 | Goldsmith et al. | 257/528 |
| 5,757,319 A | | 5/1998 | Loo et al. | 342/375 |
| 5,880,921 A | | 3/1999 | Tham et al. | 361/233 |
| 5,959,516 A | | 9/1999 | Chang et al. | 334/14 |
| 6,000,287 A | | 12/1999 | Menzel | 73/514.32 |
| 6,069,540 A | | 5/2000 | Berenz et al. | 333/101 |
| 6,091,050 A | | 7/2000 | Carr | 219/201 |
| 6,094,102 A | | 7/2000 | Chang et al. | 331/17 |
| 6,127,908 A | | 10/2000 | Bozler et al. | 333/246 |
| 6,143,997 A | | 11/2000 | Feng et al. | 200/181 |
| 6,154,176 A | | 11/2000 | Fathy et al. | 343/700 |
| 6,175,170 B1 | | 1/2001 | Kota et al. | 310/40 |
| 6,198,438 B1 | * | 3/2001 | Herd et al. | 343/700 MS |
| 6,239,762 B1 | * | 5/2001 | Lier | 343/770 |
| 6,307,519 B1 | * | 10/2001 | Livingston et al. | 343/767 |
| 6,320,547 B1 | * | 11/2001 | Fathy et al. | 343/700 MS |
| 6,377,217 B1 | * | 4/2002 | Zhu et al. | 343/700 MS |
| 6,388,623 B1 | * | 5/2002 | Sakota et al. | 343/700 MS |
| 6,396,440 B1 | * | 5/2002 | Chen | 343/700 MS |
| 6,396,441 B2 | * | 5/2002 | Perrott et al. | 343/700 MS |
| 6,396,449 B1 | * | 5/2002 | Osterhues et al. | 343/754 |

OTHER PUBLICATIONS

Lee, Y.C., "High–q Tunable Capacitors and Multi–way Switches Using Mems for Millimeter–wave Application", online presentation at *http://mems.colorado.edu/c1.res.ppt/ppt/rf.ppt rev.09.98/top.shtml?nomenu*, University of Colorado, 2000.

(List continued on next page.)

*Primary Examiner*—Don Wong
*Assistant Examiner*—Shih-Chao Chen
(74) *Attorney, Agent, or Firm*—Sheridan Ross P.C.

(57) ABSTRACT

Method and apparatus for providing a configurable circuit are disclosed. In addition, method and apparatus for providing a phased array antenna having an integrated configurable circuit are provided. According to the present invention, at least a first component of a configurable circuit is formed on a first substrate. At least a second component of a configurable circuit is formed on at least a portion of a moveable cantilever formed from a second substrate. The first and second substrates are registered with one another to form a completed configurable circuit. According to the present invention, a configurable circuit may comprise a variable capacitor or a switch. In addition, a configurable circuit may be used in connection with phase shifting a radio frequency signal provided to an element of a phased array antenna. Antennas having integrated configurable circuits may be formed by registering and interconnecting a completed configurable circuit with a plurality of radiator elements, and with a feed network. The present invention also allows antennas with integrated configurable circuits having relatively large surface areas to be economically produced.

65 Claims, 14 Drawing Sheets

OTHER PUBLICATIONS

Wang, Chunjun, et al., "Flexible Circuit–Based RF MEMS Switches", Proceedings of 2001 ASME International Mechanical Engineering Congress and Exposition, Nov. 11–16, 2001, New York, NY, ASME 2001.

Hoivi, Nils, M.A., et al., "Digitally Controllable Variable High–Q MEMS Capacitor for RF Applications", NSFCenter for Advanced Manufacturing and Packaging of Microwave, Optical and Digital Electronics, University of Colorado.

Wu, Huey D., et al., "MEMS Designed for Tunable Capacitors", NSFCenter for Advanced Manufacturing and Packaging of Microwave, Optical and Digital Electronics, University of Colorado.

Irwin, Ronda, et al., "Quick Prototyping of Flip Chip Assembly with MEMS", University of Colorado.

Harsh, Kevin F., et al., "Flip–Chip Assembly for SI–Based RF MEMS", NFS Center for Advanced Manufacturing and Packaging of Microwave, Optical and Digital Electronics, University of Colorado.

Gupta, K.C., "MEMS–based Reconfigurable Slot Antennas", NSF Center for Advanced Manufacturing and Packaging of Microwave, Optical and Digital Electronics, University of Colorado.

Gupta, K.C., et al., "Design of Frequency–Reconfigurable Rectangular Slot Ring Antennas", NSF Center for Advanced Manufacturing and Packaging of Microwave, Optical and Digital Electronics, University of Colorado.

Defense Advanced Research Projects Agency, Special Projects Office, overview of "Reconfigurable Aperture Program (RECAP)", available at *www.darpa.mil/spo/programs/recap.htm*, downloaded Feb. 19, 2002.

Defense Advanced Research Projects Agency, Special Projects Office,"Agent & Contractor Information" for RECAP Program, available at *www.darpa.mil/spo/programs/RECAP/afrl.htm*, downloaded Feb. 19, 2002.

* cited by examiner

ELECTROMECHANICAL SWITCHING FOR CIRCUITS CONSTRUCTED WITH FLEXIBLE MATERIALS

FIELD OF THE INVENTION

The present invention relates to flexible and configurable circuits and to electromechanical switching for microwave circuits constructed from polymers. In particular, the present invention relates to the provision of multiple radio frequency phase shifters and attenuators having a low insertion loss for use in connection with an array of radiator elements.

BACKGROUND OF THE INVENTION

Antennas are used to radiate and receive radio frequency signals. The transmission and reception of radio frequency signals is useful in a broad range of activities. For instance, radio wave communication systems are desirable where communications are transmitted over large distances. In addition, the transmission and reception of radio wave signals is useful in connection with obtaining position information regarding distant objects.

Various parameters of a radio frequency signal may be controlled in connection with an antenna for the transmission and reception of such a signal. For example, the amplitude or phase of a radio frequency signal may be selectively controlled. In addition, an antenna may itself be controlled to selectively transmit and receive a desired frequency or band of frequencies, while rejecting other frequencies. In order to selectively control parameters of a radio frequency signal or to control the characteristics of an antenna, configurable circuitry may be used. One type of antenna for transmitting and receiving radio frequency signals that often features configurable circuitry is the phased array antenna.

A phased array antenna includes a number of radiating elements. In a typical phased array antenna system, the radio frequency signal provided to (or received from) each radiator element may be separately controlled. Among the parameters of a radio frequency signal that may be controlled with respect to an individual radiator element are the amplitude of the phase of the signal provided to each radiating element. Controlling the amplitude of the signal allows the signal strength to be tapered across the array's elements to provide a desired gain pattern. Controlling the phase of a plurality of radiator elements in a coordinated fashion allows the antenna to be electronically pointed in space. Accordingly, a phased array antenna may be pointing of an antenna beam by controlling the phase of radio frequency signals provided to individual radiator elements allows the antenna to scan its beam.

In order to provide an antenna in which a characteristic of the signal, such as the phase of the signal, is controlled, selectively configurable antenna circuitry is required. For example, to control the phase of a signal, delay lines may be selectively switched into or out of the feed circuitry used to supply the radio frequency signal to a corresponding radiator element. However, delay lines are disadvantageous for use in connection with mobile or space-based antenna applications. In addition, the use of delay lines requires the inclusion of electrical or mechanical switches in the antenna circuitry. Such switches can result in insertion losses, and increase the cost of the antenna system by requiring the placement of individual switches. Switches having moving parts also generally require additional steps to seal those parts from contaminants, increasing the cost of systems utilizing such switches.

Another approach for controlling the phase of radio frequency signals involves the use of tuned reflection circuits, such as a 90° hybrid. In general, a 90° hybrid features open circuit stubs of equal length to force a reflected signal to sum in phase at the output port of the reflection circuit and subtract at the input port. The phase shift imported to a signal by the reflection circuit can be altered by altering the electrical length of the stubs. For example, a positive-intrinsic-negative (PIN) diode or discrete mechanical switch may be used to connect the stub to an additional length of conductive material. However, the use of PIN diodes can result in significant insertion losses. In addition, the use of conventional electronic or mechanical switches requires that individual switches be positioned with respect to the stubs of the reflector circuit, and be interconnected to the phase shifter circuit and to control electronics. As can be appreciated, the process of positioning and interconnecting individual mechanical switches or PIN diodes is a time consuming, laborious process.

Another approach has been proposed for providing a phase shifter circuit for use in connection with spatial signal combiners, such as coplanar wave guides or slot line antenna circuits. According to this approach, a polyimide, beam type switch is used to selectively vary the effective length of a slot line. The moveable beam of the switch is formed by two parallel slots in a polyimide layer. An electrode on the beam electrically connects adjacent sides of the slot. A DC bias voltage is selectively applied to the beam, and in particular to the electrode on the beam, to control the distance of the beam from a substrate. However, because the electrode on the moveable beam does not provide a signal path that is distinct from the electrode, the beam type switch is not readily adaptable to non-slot line circuits. In particular, such switches are not adaptable for use with transmission line circuits, such as microstrip or strip line type antenna circuits, without the additional complexity and signal amplitude losses caused by filters needed to separate the radio frequency signals from the DC bias voltages.

Therefore, there is a need for a method and an apparatus for providing a configurable circuit for use in connection with a transmission line radio frequency circuit, such as a microstrip or stripline antenna circuit. In particular, there is a need for a method and an apparatus for providing a configurable circuit for use in connection with radio frequency transmission lines that can be manufactured efficiently, without requiring the placement and interconnection of individual electronic or mechanical switches. Furthermore, there is a need for a configurable circuit for use in connection with radio frequency transmission lines that features low insertion loss. In addition, there is a need for such a configurable circuit that is capable of being produced economically in relatively large sheets, for use in connection with array antennas having a relatively large surface area. There is also a need for configurable circuits having moveable parts that can be produced without incurring additional time and expense to seal those moving parts from the environment.

SUMMARY OF THE INVENTION

In accordance with the present invention, a flexible, configurable circuit for use in providing switching or variable capacitance using capacitive or metal to metal coupling is disclosed. Also disclosed is a method for economically producing configurable circuits. In general, a configurable circuit in accordance with the present invention is formed from layers of material. Certain layers of the material have formed thereon at least one component of the configurable circuit. The completed configurable circuit is formed by registering the various layers such that the components of the configurable circuit are placed in a defined relationship with one another, and interconnecting the layers to form an operable configurable circuit. The configurable circuit of the present invention may be useful in connection with circuits that may benefit from or require a variable capacitance or mechanical switching, including metal contact switching, provided by the present invention.

According to an embodiment of the present invention, a configurable circuit is provided having at least a first component formed on a first planar substrate. At least a second component is formed on a flexible, second planar substrate. Also formed on the second planar substrate is at least a first moveable cantilever. The first and second planar substrates are spaced apart from one another, for example by a spacer layer that is relieved in the area of the at least a first moveable cantilever, to allow the at least a first moveable cantilever to move relative to the first substrate. By registering and interconnecting the first and second planar materials such that the at least a first component and the at least a second component are in a defined relationship to one another, a configurable circuit element is formed. A provided spacer layer may comprise an adhesive for interconnecting the first and second substrates.

According to another embodiment of the present invention, multiple at least first components are formed on a first substrate, multiple at least second components are formed on a flexible second substrate, and multiple moveable cantilevers are formed on the second substrate. The first and second substrates are registered such that the multiple at least first components are placed in a defined relationship with the multiple at least second components. The first and second substrates are separated from one another, for example by a spacer layer that has been relieved in the areas of the moveable cantilevers. By interconnecting the first and second layers, multiple configurable circuit elements are formed. Furthermore, the multiple circuit elements are formed substantially simultaneously, in that they are all formed during registration and interconnection of the first and second layers.

According to yet another embodiment of the present invention, a third planar substrate, having formed thereon at least a third component of a configurable circuit element is provided. The third planar substrate may then be interconnected to the second planar substrate, such that the moveable component or components of the second layer are sealed from the outside environment. The second and third substrates may be separated from one another to promote movement of the moveable cantilever or cantilevers, for example by a spacer layer that has been relieved in the area of the moveable cantilever or cantilevers.

According to still another embodiment of the present invention, a configurable circuit is provided in connection with a phased array antenna apparatus. The antenna may include a first planar material, having formed thereon at least first components of a plurality of configurable circuit elements. At least second components of the configurable circuit elements may be formed on a flexible second material, in which incisions have been made to form a plurality of moveable cantilevers. The antenna may also include a third planar material, having formed thereon a plurality of radiator elements. The first, second and third materials are registered, such that each of the plurality of radiator elements and each of the at least second components are placed in a defined relationship with a corresponding one of the at least first components. In particular, the materials are aligned to achieve the desired correspondence between components and to interconnect each of the at least first components to a corresponding one of the radiator elements.

According to the method of the present invention, the layers of the antenna having a plurality of radiator elements and a plurality of integrated configurable circuit elements are formed using conventional printed circuit board manufacturing techniques. For example, conductive traces on each of the layers may be formed using conventional chemical or mechanical etching or deposition techniques. Furthermore, the layer of material on which the moveable cantilevers are formed may utilize a flexible substrate, such as a polyimide. According to still another embodiment of the present invention, all of the layers of the antenna assembly utilize flexible substrates and/or flexible materials, to provide a flexible, configurable circuit that may conform to a surface that is not planar.

According to another embodiment of the present invention, the surface area of the flexible, configurable circuit is approximately equal to the surface area of the layer on which associated antenna radiator elements are formed. According to still another embodiment of the present invention, the flexible, configurable circuit is formed without requiring the placement and interconnection of individual switches. In accordance with yet another embodiment of the present invention, the at least first components of the flexible, configurable circuit are formed substantially simultaneously. In addition, the at least second components of the flexible, configurable circuit are formed substantially simultaneously. In accordance with a further embodiment of the present invention, all aspects of the flexible, configurable circuit are completed substantially simultaneously when the layer having the at least first components is registered with and interconnected to the layer having at least second components.

According to still a further embodiment of the present invention, an additional layer is provided. The additional layer may comprise a planar fourth material on which additional components of each of a plurality of circuit elements are formed. This further embodiment allows the configurable circuit to provide additional operating modes. The provision of such an additional layer, with or without additional components, also results in a configurable circuit in which all of the moving parts are sealed, without requiring any additional packaging.

According to one embodiment of the present invention, configurable circuit elements are provided in connection with each antenna radiator element. Accordingly, the characteristics of the circuit interconnected to each radiator element may be individually controlled.

Based on the foregoing summary, a number of salient features of the present invention are readily discerned. A flexible, configurable circuit can be provided. The configurable circuit may include a variable capacitor and/or switch. The configurable circuit may be used in connection with an antenna, such as an antenna having a plurality of radiator elements. The configurable circuit features low insertion losses, and the ability to control aspects of a signal in connection with a selected antenna element. In addition, the configurable circuit may be produced economically, using conventional printed circuit board techniques, and without requiring the placement of discrete components. The configurable circuit may also provide moving parts that are sealed by the component layers of the configurable circuit, without requiring additional packaging. The flexible, configurable circuit is well suited for use in connection with antenna arrays having a relatively large surface area and in connection with antenna arrays that must conform to surfaces that are not planar.

Additional advantages of the present invention will become readily apparent from the following discussion, particularly when taken together with the accompanying drawings.

DETAILED DESCRIPTION

In accordance with the present invention, a flexible, configurable circuit and a method for producing same are provided.

Figure 1:
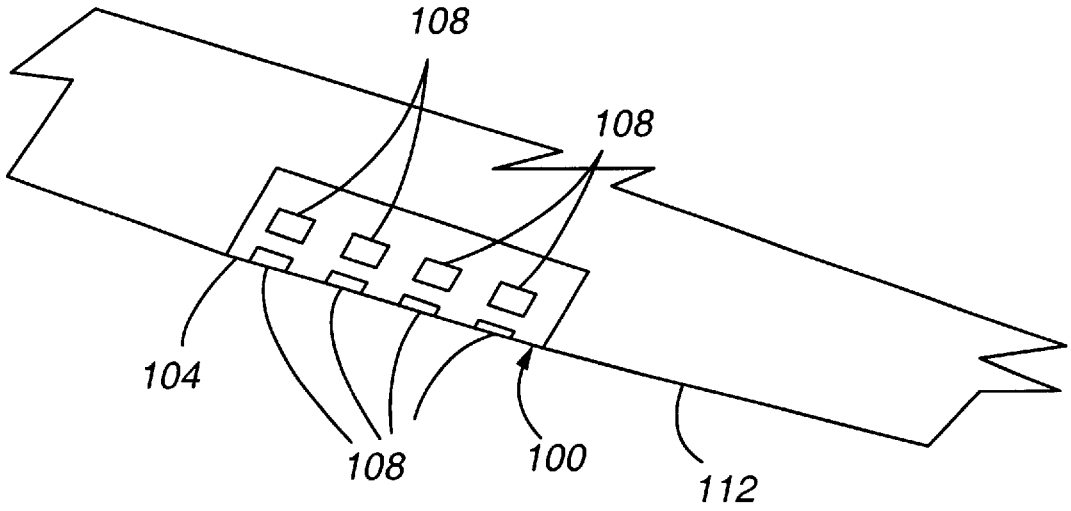
FIG. 1 is a perspective view of a phased array antenna in accordance with an embodiment of the present invention, mounted on the exterior surface of a vehicle.

With reference to FIG. 1, a phased array antenna 100 in accordance with an embodiment of the present invention is illustrated. The phased array antenna 100 includes a substantially planar first material 104, on which a plurality of radiator elements 108, only some of which are visible in FIG. 1, are formed. As shown in FIG. 1, the phased array antenna 100 may be formed from materials that allow the phased array antenna 100 to conform to a non-planar surface, such as the fuselage of an airplane, satellite or other vehicle 112. Accordingly, the substantially planar first material 104 may be flexible to allow the phased array antenna assembly 100 to conform to a non-planar surface. Furthermore, the radiator elements 108 may be formed from thin films of electrically conductive material that are also capable of conforming to a non-planar surface.

Figure 2A:
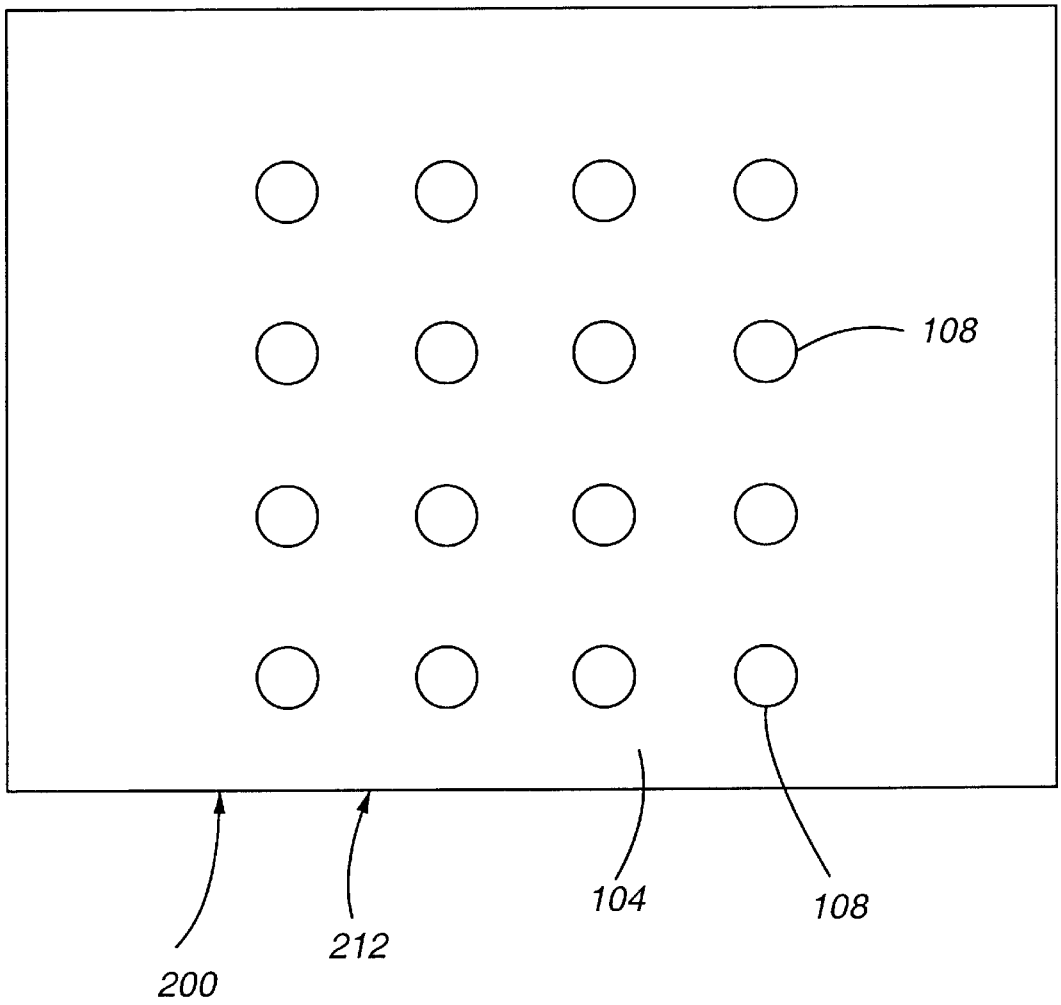
FIG. 2A illustrates an aperture layer of a phased array antenna in accordance with an embodiment of the present invention.
Figure 2B:
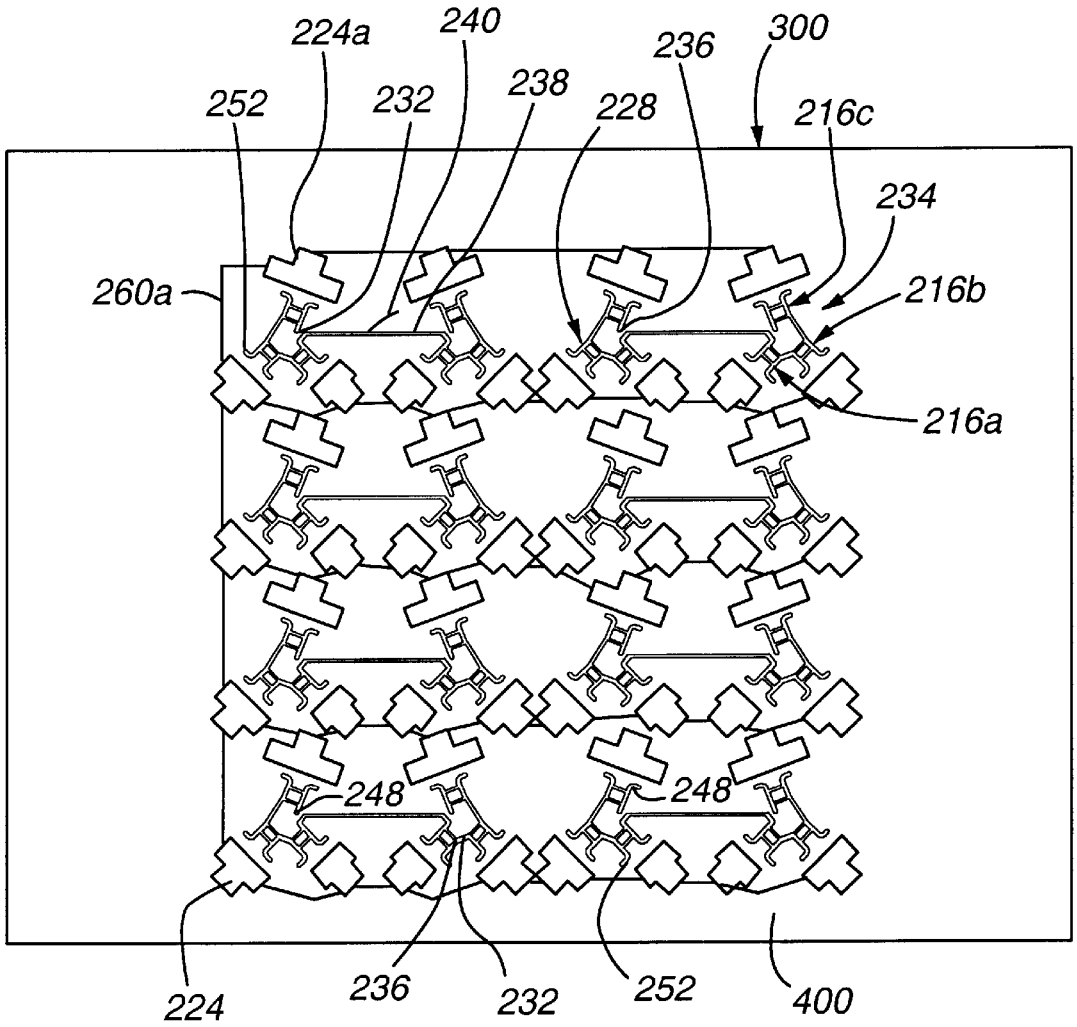
FIG. 2B illustrates a first configurable circuit layer of a phased array antenna in accordance with an embodiment of the present invention.
Figure 2C:
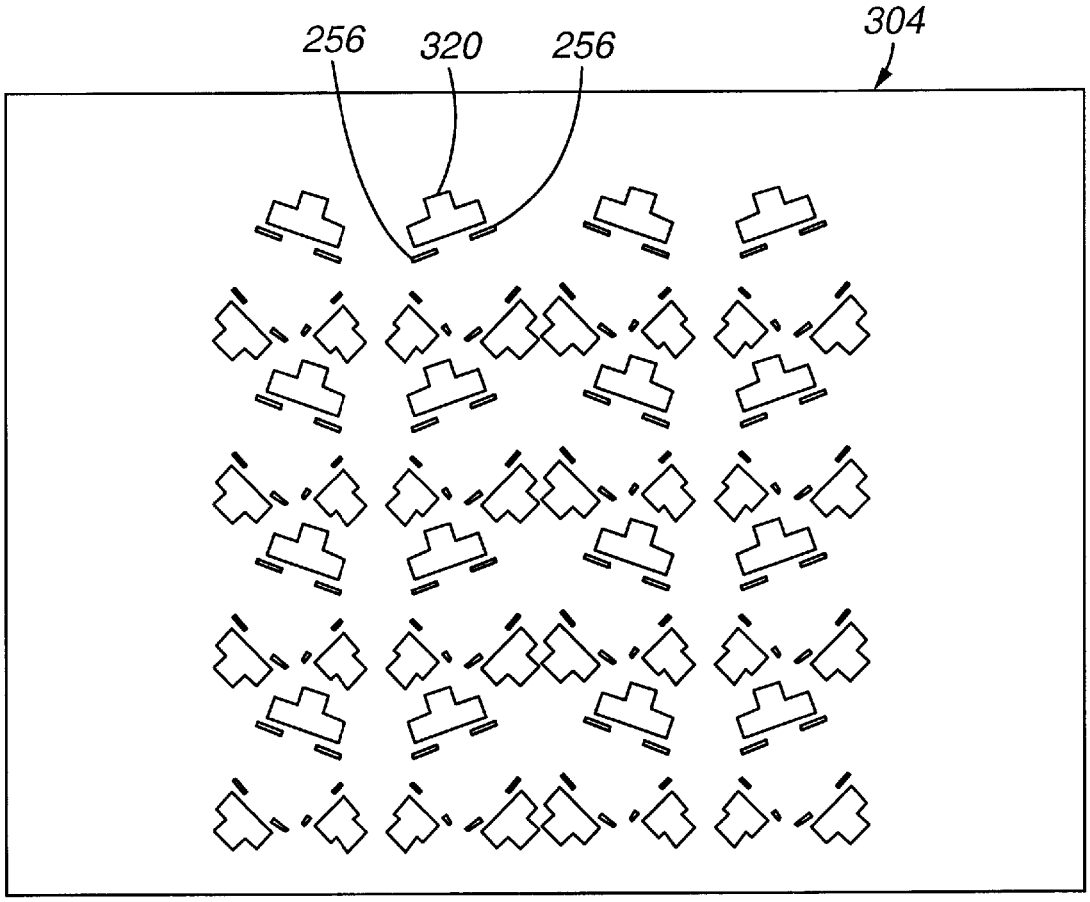
FIG. 2C illustrates a second configurable circuit layer of a phased array antenna in accordance with an embodiment of the present invention.
Figure 2D:
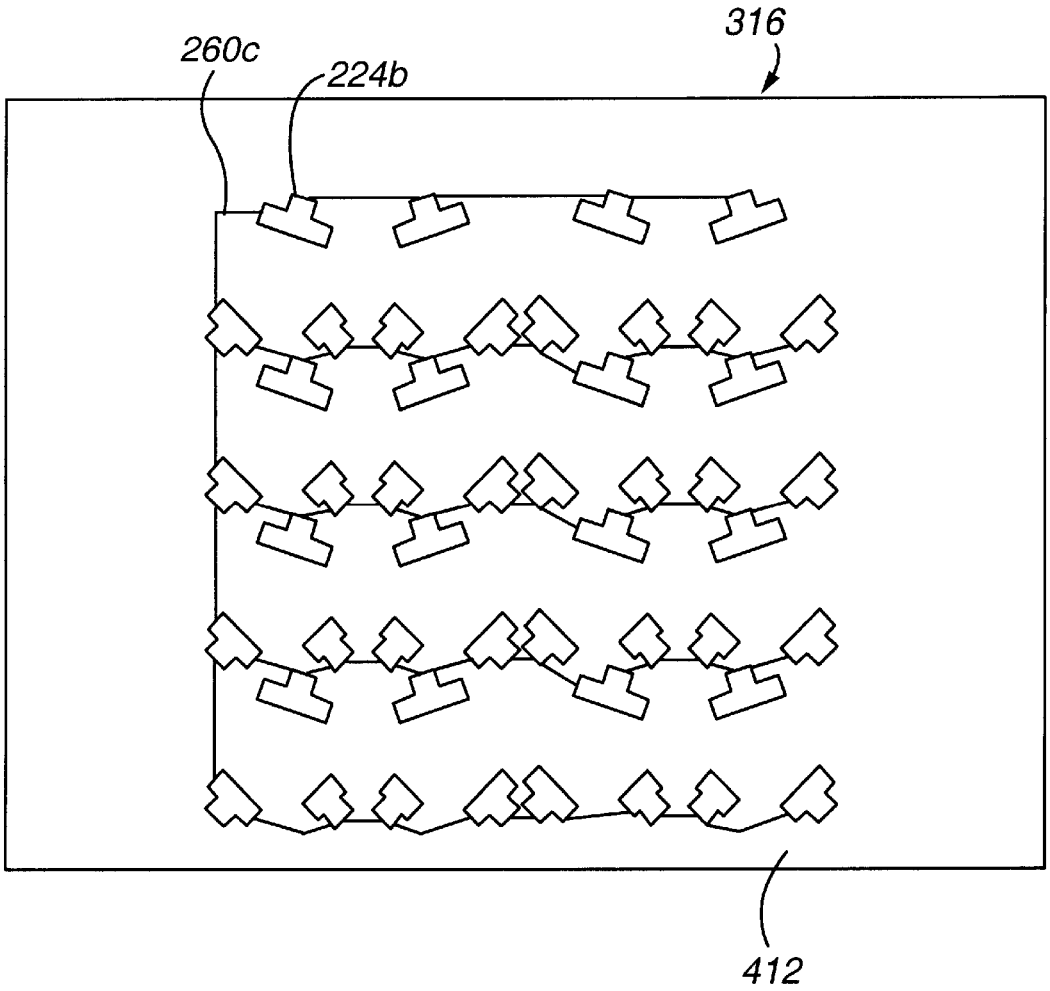
FIG. 2D illustrates a third configurable circuit layer of a phased array antenna in accordance with an embodiment of the present invention.
Figure 2E:
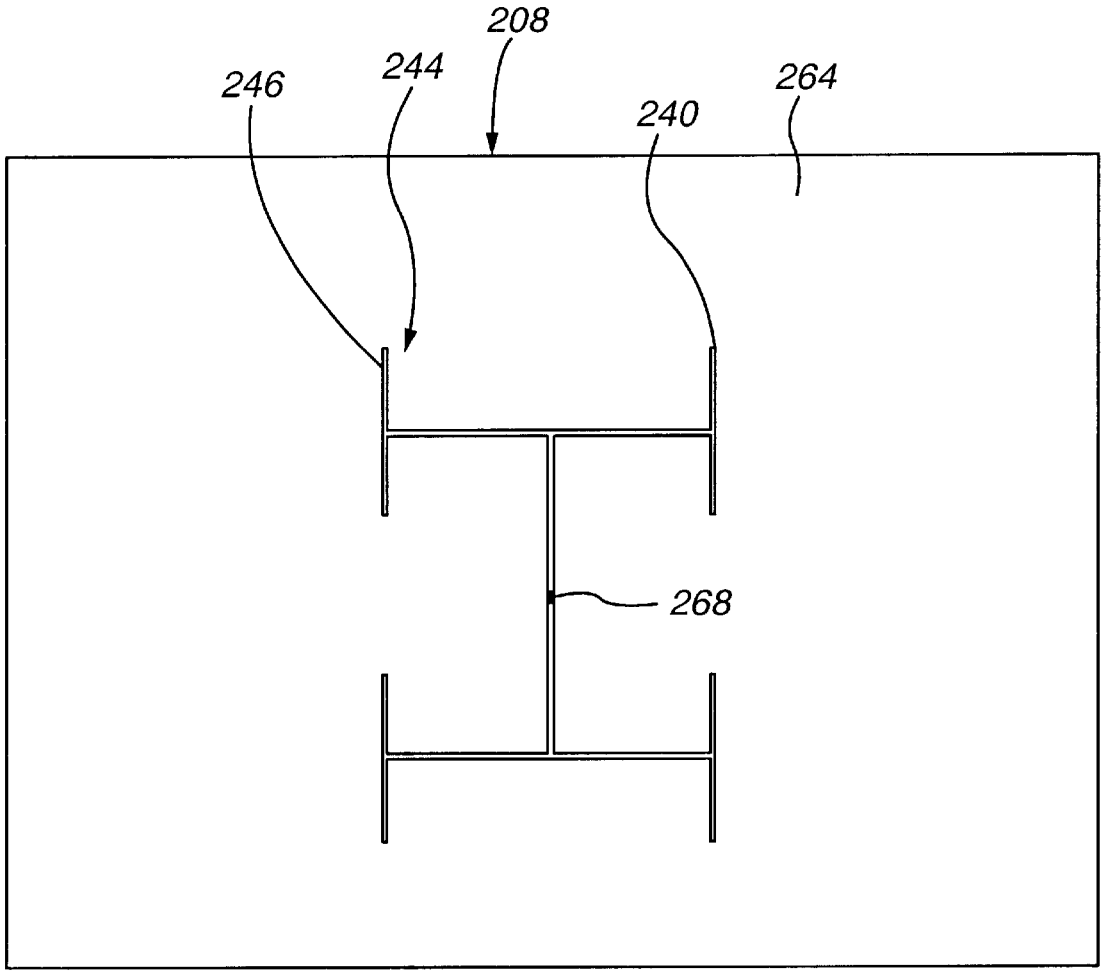
FIG. 2E illustrates a combiner layer of a phased array antenna in accordance with an embodiment of the present invention.

With reference to FIGS. 2A, 2B, 2C, 2D and 2E, the three layers comprising an operative phased array antenna 100 in accordance with an embodiment of the present invention are illustrated. In particular, the layers include an aperture layer 200 (FIG. 2A), a first configurable circuit layer 300 (FIG. 2B), a second configurable circuit layer 304 (FIG. 2C), a third configurable circuit layer 316 (FIG. 2D), and a combiner layer 208 (FIG. 2E). In FIG. 2, the layers 200, 300, 304, 316, and 208 are shown alongside one another to more clearly illustrate the individual layers. However, it will be appreciated that the layers 200, 300, 304, 316 and 208 are registered such that they lay one on top of the other when the phased array antenna 100 is in a fully assembled condition.

The aperture layer 200 generally includes a substrate or substantially planar first material 104 and a plurality of radiator elements 108. As noted above, the planar first material 104 may be formed from a flexible material, particularly in connection with embodiments of the phased array antenna 100 for mounting on a non-planar surface. Furthermore, the substantially planar first material 104 may be formed from a dielectric. As also noted above, the radiator elements 108 may be formed from electrically conductive materials. As will be understood by one of skill in the art, the geometry and dimensions of the radiator elements 108 are determined by the operating frequency or range of frequencies of the antenna 100. Taken together, the radiating elements 108 form a radiator array 212. In accordance with one embodiment of the present invention, the aperture layer 200 is formed from a polyimide material that provides a flexible, dielectric substrate (e.g., the substantially planar first material 104) with a layer or film of electrically conductive material from which the plurality of radiator elements 108 are formed.

Configurable circuit elements or assemblies 216 (see, e.g., FIG. 3A) are formed when the first 300 second 304, and third 316 configurable circuit layers are registered and interconnected. Each of the configurable circuit elements 216 may include a number of components. For example, each configurable circuit element 216 generally includes a moveable electrode 320 (FIG. 2C), a first fixed electrode 224*a* (FIG. 2B) and a second fixed electrode 224*b* (FIG. 2D). The moveable electrode 320 and the fixed electrodes 224 generally occupy separate planes, and are in an at least a partially overlapping relationship when an individual configurable circuit element is considered in plan view. Each configurable circuit element 216 also includes a reflection circuit 228 having a radio frequency input line 232 and a radio frequency output line 236 (FIG. 2B). The reflection circuit 228 is generally electrically separate from the fixed electrode 224. It will be appreciated that the functions of the radio frequency input line 232 and of the radio frequency output line 236 are reversed when the phased array antenna assembly 100 is in a receive, rather than a transmit, mode. Although the phased array antenna apparatus 100 will generally be described herein in terms of signal transmission, it will be appreciated by those of skill in the art that components will typically have a reciprocal function when the phased array antenna apparatus 100 is receiving a signal.

As shown in FIG. 2B, individual configurable circuit elements 216*a–c* may be interconnected to form a multiple bit phase shifter 234. An input feed line 238 and via 240, in electrical contact with the radio frequency input 232 of the first configurable circuit element 216*a* of a multiple bit phase shifter 234 is provided for interconnecting the input line 232 to a feed network 244 (FIG. 2E). An input via 240 extends down, into the page, from the radio frequency input feed line 238 and to the feed network 244 of the feed layer 208 (FIG. 2E). For each multiple bit phase shifter 234, an output via 248 extends up, out of the page in FIG. 2, to place the radio frequency output line 236 of the configurable circuit element 216*c* most distal from the input feed line 240 in electrical contact with a corresponding one of the radiator elements 108 of the aperture layer 200 when the aperture layer 200 and the configurable circuit layer 204 are operatively connected.

On a side of the reflection circuit 228 opposite the radio frequency input line 232 and the radio frequency output line 236 are stationary circuit members, such as stationary stubs 252. In general, by tuning the length of the stationary stubs 252, the phase delay introduced by the reflection circuit 228 can be tuned with respect to a selected center frequency.

Adjacent the stationary stubs 252, and formed on the moveable cantilever (not shown in FIG. 2; see below starting with the discussion of FIG. 3 for a fuller description of the moveable cantilever) in connection with each configurable circuit element 216, are moveable circuit members, such as moveable stubs 256 (FIG. 2C). In accordance with one embodiment of the present invention, by altering the distance between the stationary stubs 252 and the moveable stubs 256, the phase delay introduced to a radio frequency signal passing through the reflection circuit 228 can be adjusted. In particular, changing the separation between the stationary stubs 252 and the moveable stubs 256 changes the capacitance between the stationary stubs 252 and the moveable stubs 256. This in turn effectively alters the electrical length of the stationary stubs 252, thereby changing the amount of phase delay introduced by the reflection circuit 228 to a radio frequency signal passed through the reflection circuit 228. Therefore, it can be appreciated that the configurable circuit elements 216 may function as variable capacitors. According to another embodiment of the present invention, the electrical length of the stationary stubs 252 may be altered by placing the moveable stubs 256 in contact with the stationary stubs 252. Therefore, it can be appreciated that the configurable circuit elements 216 may function as switches.

Figure 2F:
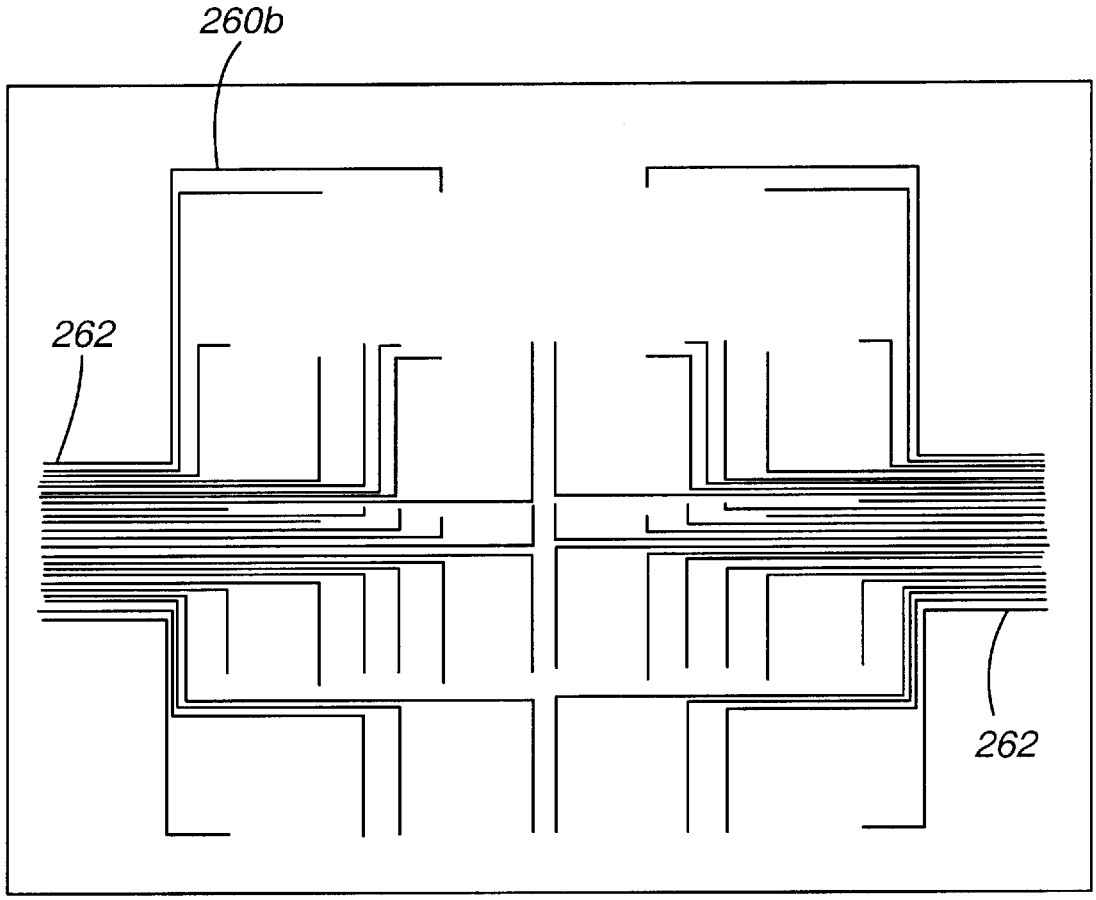
FIG. 2F illustrates DC bias control traces in accordance with an embodiment of the present invention.

DC bias supply lines 260 interconnect each of the electrodes, including each of the fixed electrodes 224 and each of the moveable electrodes 320, to a voltage source (not shown). In general, the DC bias supply lines 260 can be used to selectively establish a voltage potential between a pair of stationary electrodes 224 and a corresponding moveable electrode 320. In particular, this voltage differential may be used to establish an attractive or repulsive electrostatic force between the stationary electrodes 224 and the moveable electrode 320, and thereby move the cantilever (not shown in FIG. 2) associated with a moveable electrode 320, and in turn the associated pair of moveable stubs 256, with respect to the stationary stubs 252. In accordance with one embodiment of the present invention, each of the stationary electrodes 224 may be provided with a DC bias voltage over DC bias supply lines 260. In particular, the stationary electrodes 224*a* of the first layer 300 may be supplied with a first DC bias voltage by DC bias supply lines 260*a*, while the stationary electrodes 224*b* of the third layer 316 may be supplied with a second DC bias voltage by DC bias supply lines 260*c*. The moveable electrodes 320 of the second layer 304 may each be provided with a dedicated DC bias supply line 260*b* (FIG. 2F), allowing independent control of the phase delay of each of the configurable circuit elements 216. For clarity, the DC bias control lines 260*c* are illustrated in FIG. 2F separately from the other components of the second layer 304, however it should be appreciated that the DC bias control lines 260*c* may be formed as part of the second layer 304, and generally in the same plane as the moveable electrodes 320. The DC bias supply lines 260*c* may be interconnected to voltage sources (not shown) using two 48 pin connectors 262 where control of 96 individual phase shifter assemblies is desired.

The combiner layer 208 generally includes a feed network 244 formed on a dielectric substrate 264 to comprise the combiner layer 208. As will be appreciated by one of skill in the art, the feed network 244 is formed from feed lines of equal length extending from a central feed distribution point 268. As noted above, the feed distribution network 244 is interconnected to the feed lines 246 and then to the radio frequency input lines 232 by the input vias 240 when the configurable circuit layer 204 and the combiner or feed network layer 208 are registered and operatively connected. The central distribution point 268 may be operatively connected to a transmitter and/or receiver (not shown).

Figure 3B:
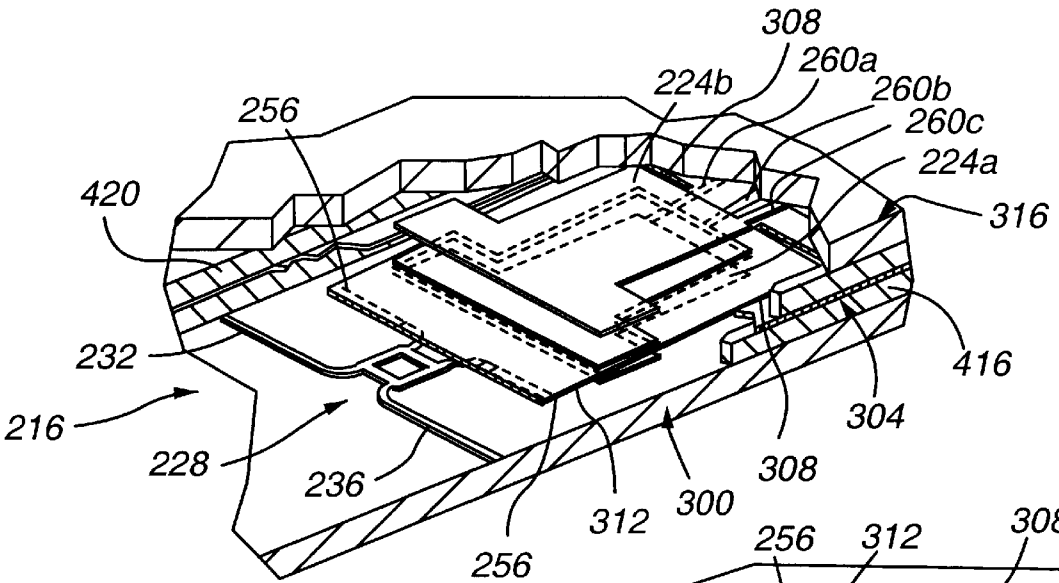
FIG. 3B is a perspective view of the configurable circuit element of FIG. 3A, with the moveable cantilever in a second position.
Figure 3A:
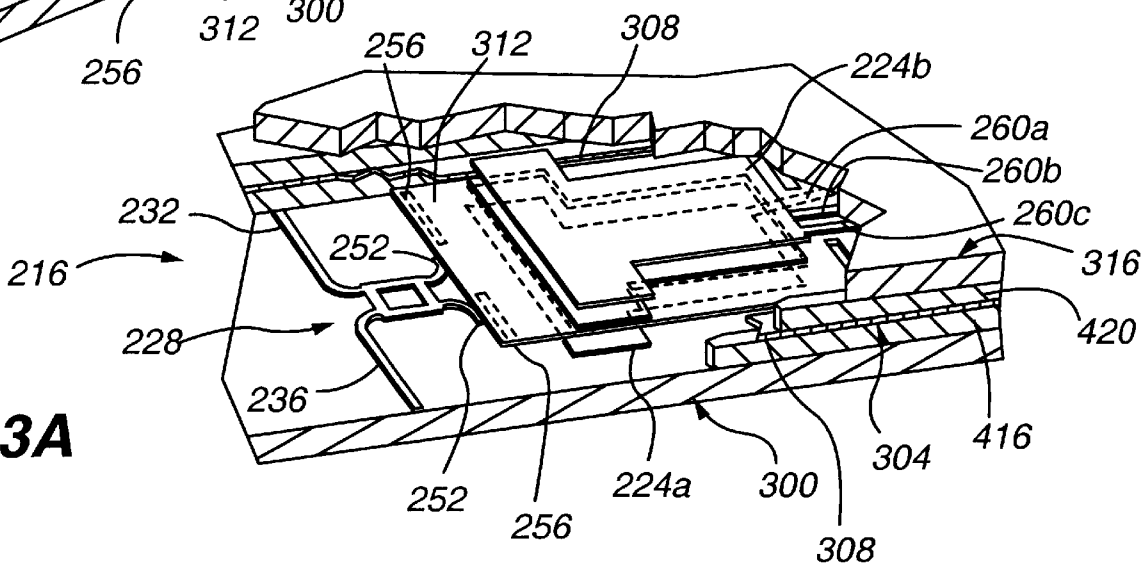
FIG. 3A is a perspective view of an individual configurable circuit element in accordance with an embodiment of the present invention, with the moveable cantilever in a first position.

With reference now to FIG. 3A, a perspective view of a configurable circuit element 216 is illustrated. As can be seen in FIG. 3A, the configurable circuit element 216 includes a first or lower configurable circuit layer 300 on which the reflection circuit 228 and the first stationary electrode 224*a* are formed. A second or middle configurable circuit layer 304 is incised to form slots 308, that in turn form a moveable cantilever 312. In FIG. 3A, the moveable cantilever 312 is shown in a first position, in which the moveable cantilever 312 is aligned with a plane described by the remaining portions of the second layer 304 (i.e. those portions not comprising a moveable cantilever 312). Located on the moveable cantilever 312 are the moveable stubs 256 and a moveable electrode 320. A third or upper configurable circuit layer 316 includes a second stationary electrode 224*b*.

In the embodiment shown in FIG. 3A, the first 300, second 304, and third 316 configurable circuit layers each includes a DC bias line 260. The DC bias line 260 may be used to selectively supply the electrodes 224*a*, 224*b*, and 320 with a voltage.

In general, each of the layers 300, 304 and 316 may comprise planar, dielectric substrates. (Substrates 400, 404 and 412 respectively. See, e.g., FIG. 4A). In addition, the second layer 304 may comprise a flexible substrate 404 to facilitate movement of the cantilever 312 with respect to the first 300 and third 316 layers. A first spacer layer 416 to is interposed between the first 300 and second 304 layers and a second spacer layer 420 is interposed between the second 304 and third 316 layers. The spacers 416 and 420 are relieved in the area of the moveable cantilever 312, to allow the moveable cantilever 312 to move with respect to the surrounding portions of the second layer 304. According to a further embodiment of the present invention, each of the layers 300, 304 and 316 may comprise a flexible, dielectric material. For example, the layers 300, 304 and 316 may comprise a polyimide material.

The various electrically conductive elements (e.g., the electrodes 222, 224 and 320, the reflection circuit 228, and the DC bias supply lines 260) may be formed from conductive material deposited on their respective substrates 400, 404 or 412. As can be appreciated by one of skill in the art, the conductive elements may be formed by etching or otherwise removing areas of the uniformly distributed conductive film to form the desired conductive elements, or the conductive elements may be deposited on the film in the desired areas to form the conductive elements. That is, printed circuit board manufacturing techniques may be used to form the conductive elements. An insulator may be formed over the electrically conductive material of the various layers 300, 304, or 316, as will be explained in detail in connection with FIGS. 4A, 4B, 4C, 5A, 5B, 6A and 6B.

With reference now to FIG. 3B, the configurable circuit element 216 illustrated in FIG. 3A is shown, with the moveable cantilever 312 in a second position deflected towards the first stationary electrode 224*a* (i.e. towards the first layer 300). As shown in FIG. 3B, the moveable stubs 256 are in close proximity to the stationary stubs 252 when the moveable cantilever 312 is in the second position. According to another embodiment. of the present invention, the moveable stubs 256 are in electrical contact with the stationary stubs 252 when the moveable cantilever 312 is in the second position. Accordingly, the electrical characteristics of the reflection circuit 228 are altered from those characteristics when the moveable cantilever is in the first position illustrated in FIG. 3A. The moveable cantilever 312 may be placed in the second position illustrated in FIG. 3B by establishing an attractive electrostatic force between the moveable electrode 320 and the first stationary electrode 224*a*. The appropriate electrostatic forces may be established using the DC bias supply lines 260*a–c*.

Figure 4A:
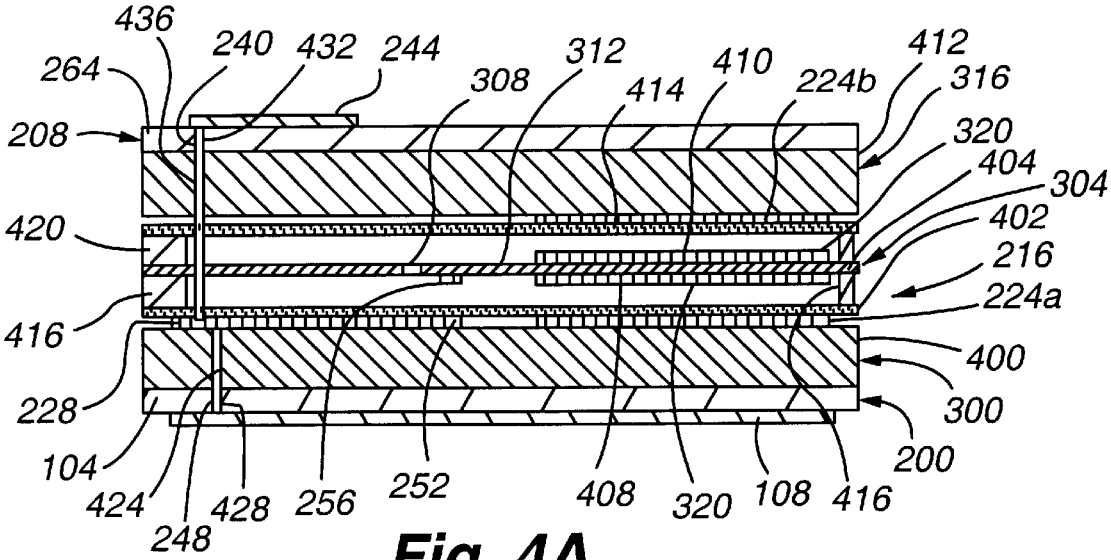
FIG. 4A is a cross-section of a portion of a configurable circuit element and an associated antenna in accordance with an embodiment of the present invention, with the moveable cantilever in a first position.

With reference now to FIG. 4A, a cross-section of a phased array antenna system comprising an aperture layer 200, a first configurable circuit layer 300, a second configurable circuit layer 304, a third configurable circuit layer 316, and a combiner layer 208 in accordance with an embodiment of the present invention is illustrated. In general, the cross-section illustrated in FIG. 4A is taken along a center line of the moveable cantilever 312. In particular, FIG. 4A illustrates a configurable circuit element 216, an associated radiator element 108, and an associated portion of the feed network 244.

As seen in FIG. 4A, the first configurable circuit layer 300 includes a substantially planar substrate 400 on which the reflection circuit 228 and the first stationary electrode 224*a* are formed. Overlaying the reflection circuit 228 and the stationary electrode 224 is a first insulator layer 402. The second layer 304 includes a substantially planar substrate 404, a moveable electrode 320, and a pair of moveable stubs 256, only one of which is visible in FIG. 4A. The moveable electrode 320 may be formed from a first moveable plate 408, formed on a surface of a flexible substrate 404 adjacent the first layer. 300, and a second moveable plate 410 located on a surface of the flexible substrate 404 adjacent the third layer 316 of the configurable circuit element 216. The third configurable circuit element layer 316 includes a substantially planar substrate 412 on which the second stationary electrode 224*b* is formed. A second insulator layer 414 is formed on a side of the-second stationary electrode 224*b* opposite the substantially planar substrate 412.

A first spacer or adhesive layer 416 is interposed between the first 300 and second 304 configurable circuit layers. The first spacer 416 serves to spatially separate the first layer 300 from the second layer 304. In addition, the first spacer 416 is relieved in the area of the moveable cantilever 312, to allow the moveable cantilever 312 to move with respect to the first layer 300. As will be described in greater detail below, the spacer 416 may comprise a dielectric material. Furthermore, the spacer 416 may comprise a dielectric adhesive interconnecting the first 300 and second 304 layers and for maintaining the registration between those layers.

A second spacer or adhesive layer 420 is interposed between the second 304 and third 316 configurable circuit layer. The second spacer 420 generally serves to spatially separate the second layer 304 from the third layer 316. In addition, the second spacer 420 is relieved in the area of the moveable cantilever 312 to allow the moveable cantilever 312 to be deflected towards the third layer 316.

With continued reference to FIG. 4A, the aperture layer 200 can be seen to include a substrate 104 with a radiator element 108 formed-thereon. In addition, the output via 248, which electrically interconnects the output line 236 of the reflection circuit 228 to the radiator element 108 can be seen in FIG. 4A. As can be appreciated by one of skill in the art, the output via 248 may be formed in a plurality of sections, for example, a first section 424 formed as part of the first configurable circuit layer 300, and a second section 428 formed as part of the aperture layer 200, the sections 424 and 428 being in electrical contact with one another when the aperture layer 200 and the configurable circuit layer 204 are registered with one another.

The combiner layer 208 can be seen in FIG. 4A to include a feed network 244 and a substrate 264. An input via 240, electrically interconnecting the feed network 244 to the radio frequency input line 232 of the reflection circuit 228 is also visible in FIG. 4A. The via 240 may be formed in sections, such as a first section 432 associated with the feed layer 208, and a second section 436 associated with the third configurable circuit layer 316.

Figure 4B:
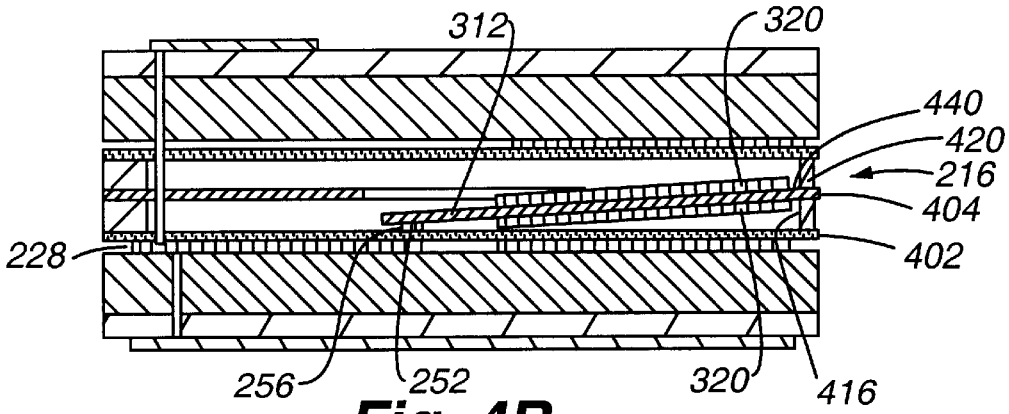
FIG. 4B is a cross-section of the portion of a configurable circuit element and an associated antenna of FIG. 4A, with the moveable cantilever in a second position.

With reference now to FIG. 4B, the cross-section of the phased array antenna system illustrated in FIG. 4A is shown, with the moveable cantilever 312 in a second position. As shown in FIG. 4B, when the moveable cantilever 312 is in the second position, the moveable stubs 256 are placed in close proximity to the stationary stubs 252 of the reflection circuit 228. However, the first insulator layer 402 prevents direct contact between the moveable stubs 256 and the stationary stubs 252 of the configurable circuit element 216. Accordingly, the capacitance between the stationary stubs 252 and the moveable stubs 256 are altered as compared to the capacitance between those elements when the moveable cantilever 312 is in the first position (shown in FIG. 4A). In addition, the moveable cantilever 312 may be placed in a third position (see FIG. 4C), in which the moveable stub 256 is in close proximity to the third layer 316, and is a greater distance from the stationary stubs 252 than in either of the first and second positions. Furthermore, it should be appreciated that intermediate positions are available, such that the capacitance between the stationary 252 and moveable 256 stubs may be continuously varied between a first value, obtained when the moveable cantilever 312 is in the second position, and a second value obtained when the moveable cantilever 312 is in the third position (or the first position if the third position is not available or is not used). The resilience of the substrate 404 allows the moveable cantilever to bend in the area 440 between the moveable electrode 320 and the spacers 416 and 420. Alternatively or in addition, the substrate 404 may be scored or reduced in the area 440 to promote bending in that area 440.

In general, the first position of the moveable cantilever (FIG. 4A) depicts the position of the moveable cantilever 312 when there is no or substantially no voltage potential between the moveable electrode 320 and either of the stationary electrodes 224*a* or 224*b*. By substantially no voltage potential, it is meant that any voltage potential between the moveable electrode 320 and either of the stationary electrodes 224 is insufficient to overcome the moveable cantilever's 312 natural position of repose. It should be appreciated that the moveable cantilever's 312 natural position of repose is not necessarily in a position that is substantially aligned with the non-moveable portions of the flexible substrate 404 (e.g, those portions of the flexible substrate 404 that are in contact with the first 416 and second 420 spacers) as illustrated in FIG. 4A. This may be due to mechanical tolerances in forming the moveable cantilever 312, or due to external influences on the moveable cantilever, such as gravity. In order to place the moveable cantilever 312 in the second position illustrated in FIG. 4B, an attractive electrostatic force may be introduced between the moveable electrode 320 and the first stationary electrode 224*a*, for example by placing a negative charge on the first stationary electrode 224*a* using DC bias line 260*a*, and a positive charge on the moveable electrode 320 over the DC bias line 260*b* for the configurable circuit element 216. Of course, it is not important which of the electrodes 224*a* or 320 is provided with a negative charge and which is provided with a positive charge. When the moveable cantilever 312 is in the second position, the first insulator layer 402 prevents the first plate 408 of the moveable electrode 320 from shorting against the first stationary electrode 224*a*.

Likewise, in order to place the moveable cantilever in the third position, an attractive electrostatic force may be established between the second stationary electrode 224*b* and the moveable electrode 320. The second insulator layer 414 prevents the second plate 410 of the moveable electrode 320 and the second stationary electrode 224*b* from shorting against one another.

The moveable cantilever 312 may be returned to the first position (FIG. 4A) by removing the electrostatic force established between the stationary electrodes 224 and the moveable electrode 320, in which case the elastic properties of the flexible substrate 404 return the moveable cantilever 312 to the first position.

Figure 5A:
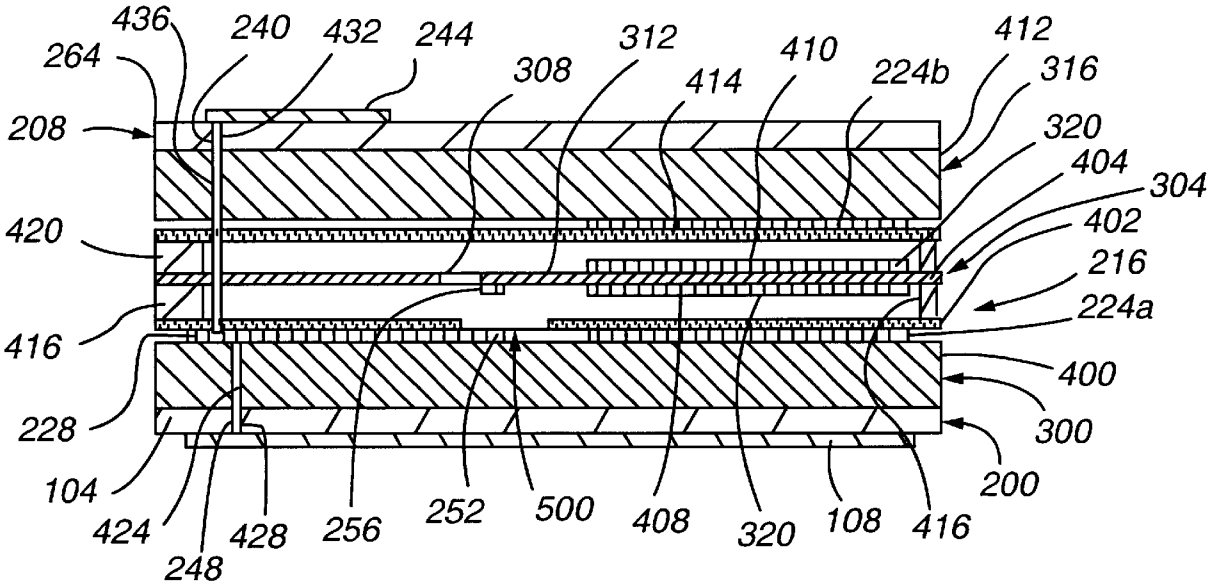
FIG. 5A is a cross-section of a portion of a configurable circuit element and an associated antenna in accordance with another embodiment of the present invention, with the moveable cantilever in a first position.

With reference now to FIG. 5A, another embodiment of a phased array antenna including a configurable circuit in accordance with the present invention is illustrated. In general, the embodiment illustrated in FIG. 5A differs from that illustrated in FIG. 4A in that the first insulator layer 402 is relieved in the area 500 adjacent the stationary stub 252. In addition, the moveable stub 256 may be plated so that it is thicker than the first plate 408 of the moveable electrode 320.

Figure 5B:
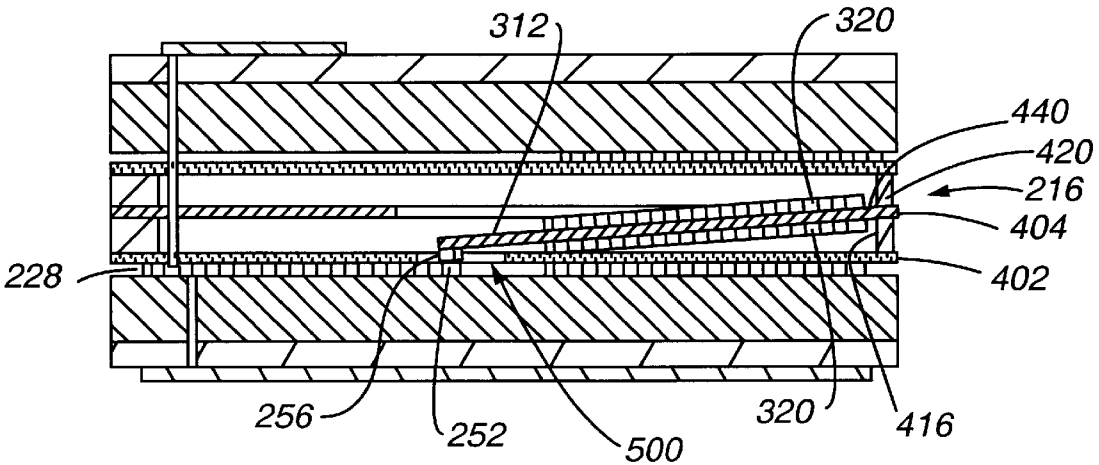
FIG. 5B is a cross-section of the portion of a configurable circuit element and an associated antenna of FIG. 5A, with the moveable cantilever in a second position.

With reference now to FIG. 5B, the phased array antenna illustrated in FIG. 5A is shown with the moveable cantilever 312 in the second position. From FIG. 5B, it is apparent that the moveable stub 256 is in direct, metal to metal contact, with the stationary stub 252. Therefore, it can be appreciated that the configurable circuit element 216 illustrated in FIGS. 5A and 5B provides a switch. Furthermore, it will be appreciated that the embodiment of the configurable circuit element 216 illustrated in FIGS. 5A and 5B is capable of functioning as a switch in which direct metal to metal contact is made between the stationary stub 252 and the moveable stub 256 because the stubs 252 and 256 are not electrically connected to the electrodes 224 and 320. Although the moveable stub 256 is illustrated as being plated at twice the thickness of the first plate 408 of the moveable electrode 320 to promote metal to metal contact between the stationary stub 252 and the moveable stub 256 when the moveable cantilever 312 is in a second position, such a configuration is not absolutely necessary. For example, depending on the geometry of the configurable circuit element 216, the moveable stub 256 may be plated at the same thickness as the bottom plate 408 of the moveable electrode 320. In addition or alternatively, the stationary stub 252 may be plated at an increased thickness to promote direct contact between the stationary stub 252 and the moveable stub 256. It will be noted that the first insulator layer 402 ensures that the first plate 408 of the moveable electrode 320 is not shorted with the first stationary electrode 224*a*.

Figure 6A:
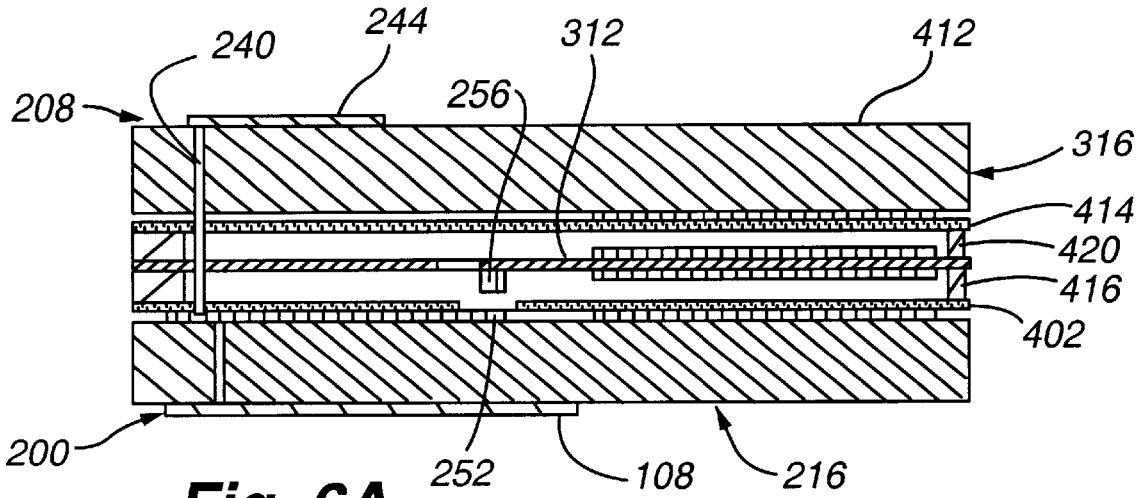
FIG. 6A is a cross-section of a portion of a configurable circuit element and an associated antenna in accordance with still another embodiment of the present invention, with the moveable cantilever in a first position.

With reference now to FIG. 6A, yet another embodiment of a phased array antenna having a configurable circuit in accordance with the present invention is illustrated. In general, the embodiment illustrated in FIG. 6A differs from that illustrated in FIG. 5A in that the radiator element 108 is formed on a surface of the substrate 400 of the first configurable circuit layer 300. Also, the feed network 244 in the embodiment of FIG. 6A is formed on a surface of the substrate 412 of the third layer 316. Accordingly, the embodiment of FIG. 6A eliminates the need for separate substrates (e.g., substrates 104 and 264 shown in FIGS. 5A, 5B and 5C) in connection with the aperture layer 200 and the feed layer 208.

Figure 6B:
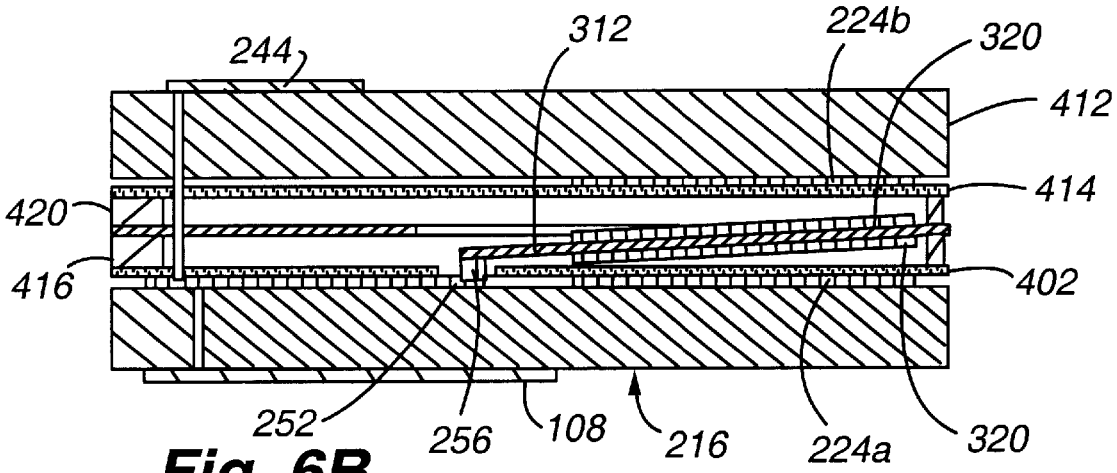
FIG. 6B is a cross-section of the portion of a configurable circuit element and an associated antenna of FIG. 6A, with the moveable cantilever in a second position.
Figure 6C:
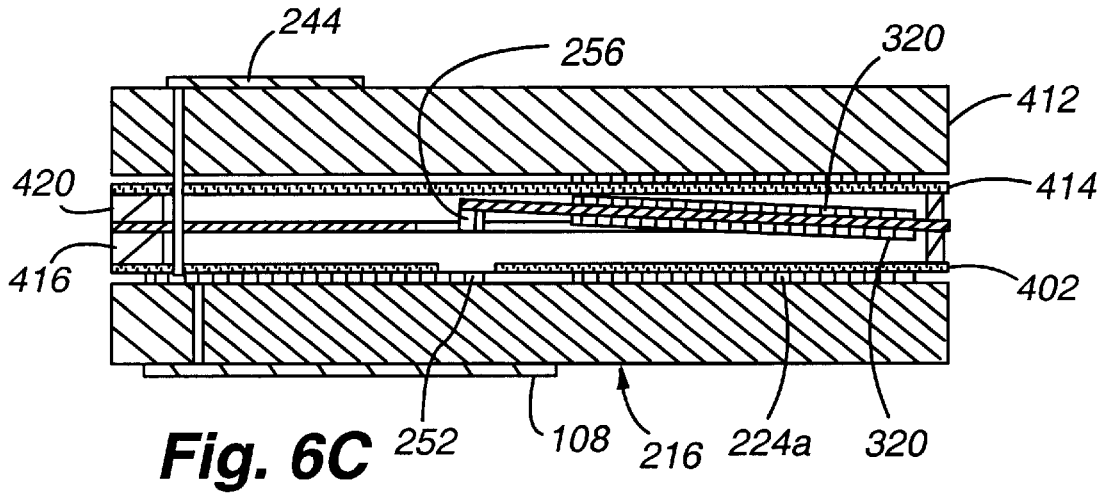
FIG. 6C is a cross-section of a portion of a configurable circuit element and an associated antenna of FIG. 6A, with the moveable cantilever in a third position.

With reference now to FIG. 6B, the embodiment of FIG. 6A is shown, with the moveable cantilever 312 in a second position. In general, the moveable cantilever may be moved between the first and second positions by creating attractive and/or repulsive electrostatic forces between the stationary electrodes 224 and the moveable electrode 320, as described above in connection with FIG. 3B. When the moveable cantilever 312 is in the second position, the moveable stub 256 may be placed in direct contact with the stationary stub 252. Accordingly, the configurable circuit element 316 may implement a switch. Alternatively, the configurable circuit element may implement a variable capacitor, for example if the first insulator layer 402 is continuous in the area of the stationary stub 252 so as to prevent direct metal to metal contact between the stationary stub 252 and the moveable stub 256. The moveable cantilever 312 may also be positioned in a third position (FIG. 6C), or in a position intermediate to the first and third positions.

Figure 7A:
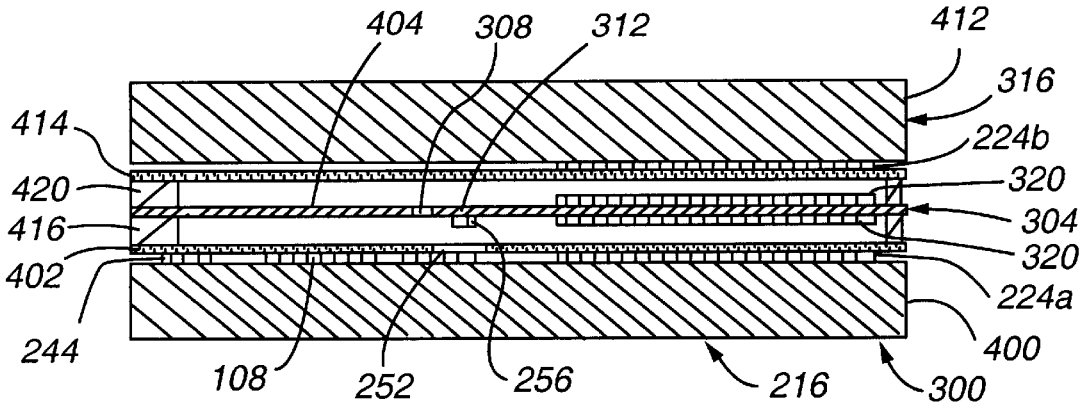
FIG. 7A is a cross-section of a portion of a configurable circuit element and an associated antenna in accordance with yet another embodiment of the present invention, with the moveable cantilever in a first position.
Figure 7B:
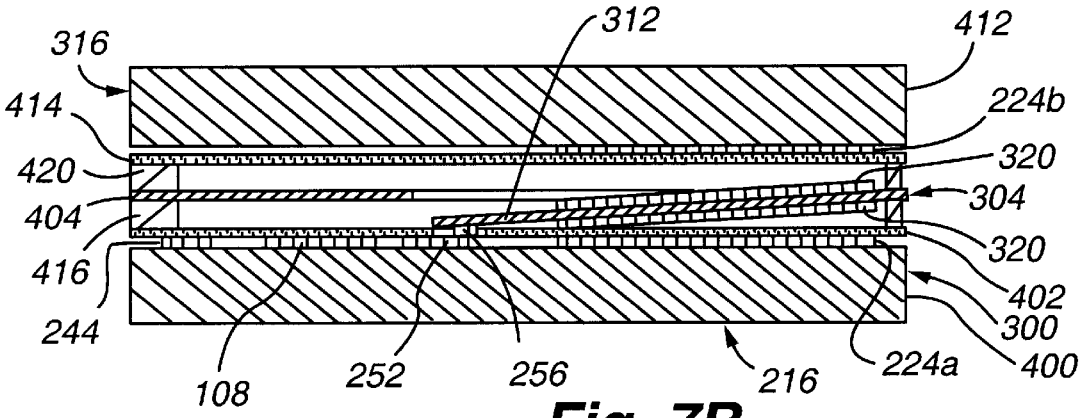
FIG. 7B is a cross-section of the portion of a configurable circuit and an associated antenna of FIG. 7A, with the moveable cantilever in a second position.
Figure 7C:
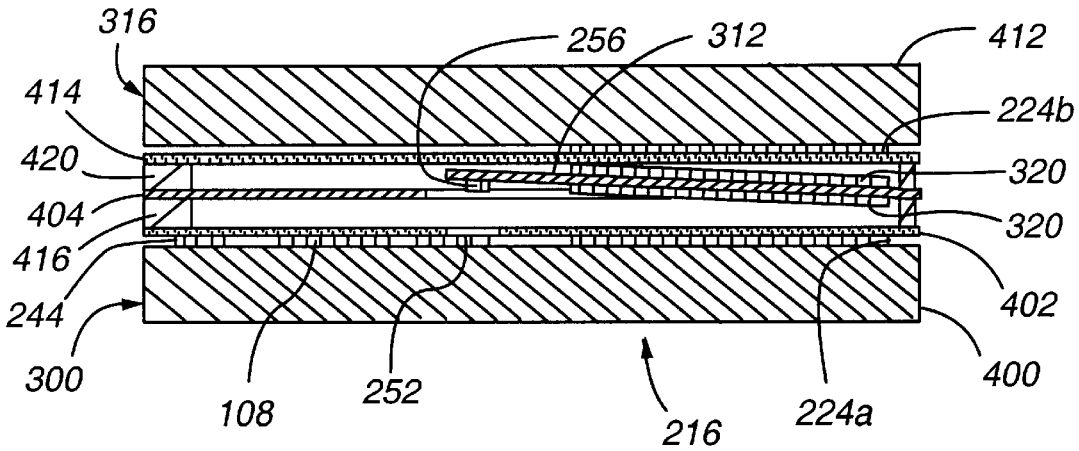
FIG. 7C is a cross-section of a portion of a configurable circuit element and an associated antenna of FIG. 7A, with the moveable cantilever in a third position.

With reference now to FIG. 7A, still another embodiment of a phased array antenna having a configurable circuit in accordance with the present invention is illustrated. In general, the embodiment illustrated in FIG. 7A differs from that illustrated in FIG. 6A in that the radiator element 108, feed network 244, stationary stub 252, and the first stationary electrode 224A, are all formed on the same surface of the substrate 400. Therefore, it will be noted that no vias are necessary with respect to the embodiment illustrated in FIG. 7A. Instead, the radiator element 108, stationary stub 252, and feed network 244 may each be electrically interconnected to one another along the surface of the substrate 400. Furthermore, it should be appreciated that a third layer 316 need not be provided according to the embodiment illustrated in FIG. 7A, if the second stationary electrode 224*b* and the sealing function of the third layer 316 with respect to the moveable cantilever 312 are not required or desired. In FIG. 7A, the moveable cantilever 312 is shown in a first position, in FIG. 7B the moveable cantilever 312 is shown in a second position, and in FIG. 7C the moveable cantilever 312 is shown in a third position.

Figure 8:
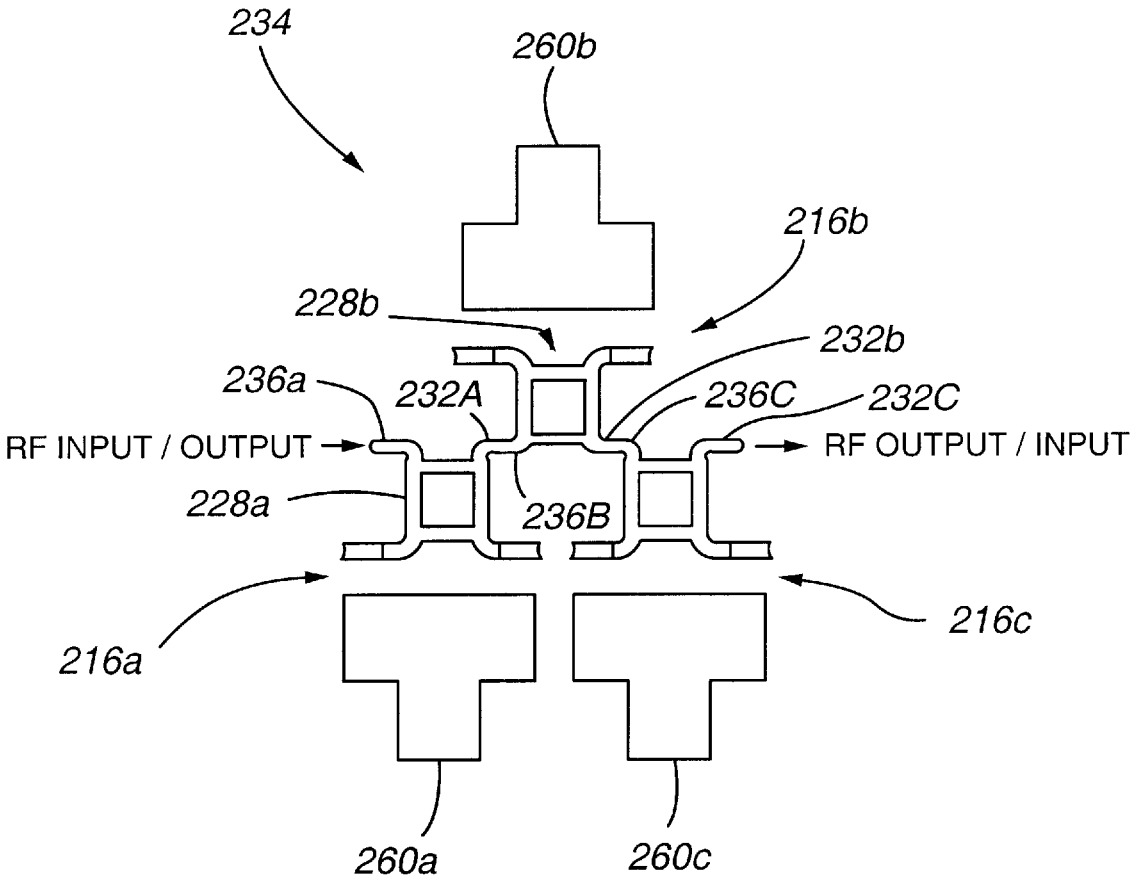
FIG. 8 depicts a three bit phase shifter assembly in accordance with an embodiment of the present invention.

With reference now to FIG. 8, a three bit phase shifter 234 arrangement in accordance with an embodiment of the present invention is shown in plan view. In general, the three bit phase shifter 234 comprises three configurable circuit elements 216, here implementing three separate phase shifter assemblies 216*a*, 216*b* and 216*c* connected in series. Thus, a radio frequency signal for transmission provided to the input 236*a* of the first reflection circuit 228*a* of the first shifter 216*a* is passed from the radio frequency output line 232*a* of the first phase shifter 216*a*, to the radio frequency input line 236*b* of the reflection circuit 228*b* associated with the second phase shifter assembly 216*b*. Likewise, the signal is passed from the radio frequency output line 232*b* of the second phase shifter assembly 216*b* to the radio frequency input line 236*c* of the third phase shifter assembly 216*c*. The radio frequency signal may then be provided to a radiator element 108 (not shown in FIG. 8) by an interconnected radio frequency transmission line or by an output via associated with the radio frequency signal output 232*c* of the third phase shifter assembly 216*c*.

As can be appreciated by one of skill in the art, the three bit phase shifter assembly 234 illustrated in FIG. 8, which may generally include three configurable circuit elements 216 as described above, can selectively provide eight different levels of phase shifting to an input radio frequency signal when each individual phase shifter 216*a–c* is capable of providing two different phase shift amounts. As can further be appreciated by one of skill in the art, each of the phase shifters 216*a–c* may be controlled as described in connection with a single configurable circuit element 216, using DC bias control lines 260*a–c*. In addition, it can be appreciated that the three bit phase shifter assembly 234 provides a phase shifter that can be included as part of a radio frequency transmission line. In particular, the three bit phase shifter assembly 234 is well-suited for use in a radio frequency transmission line circuit because it offers electrical isolation between the electrodes used to control the phase shift of each individual phase shifter 216*a–c* and the radio frequency signal. In accordance with another embodiment of the present invention, by interconnecting n configurable circuit elements 216, an n-bit phase shifter or signal attenuator assembly can be provided. In accordance with a further embodiment of the present invention, the phase shifter assemblies 216 may be replaced by variable attenuators that are switched using configurable circuit elements in accordance with the present invention to provide a three bit signal attenuator.

Figure 4C:
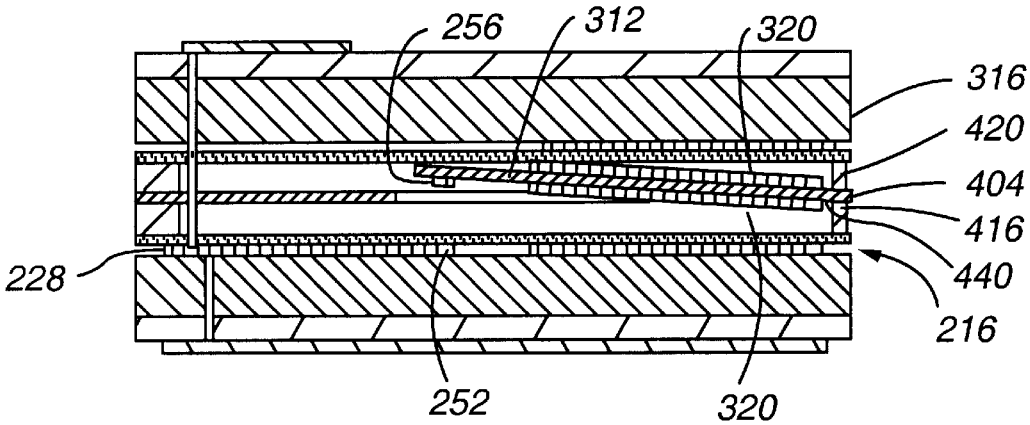
FIG. 4C is a cross-section of the portion of a configurable circuit element and an associated antenna of FIG. 4A, with the moveable cantilever in a third position.
Figure 9:
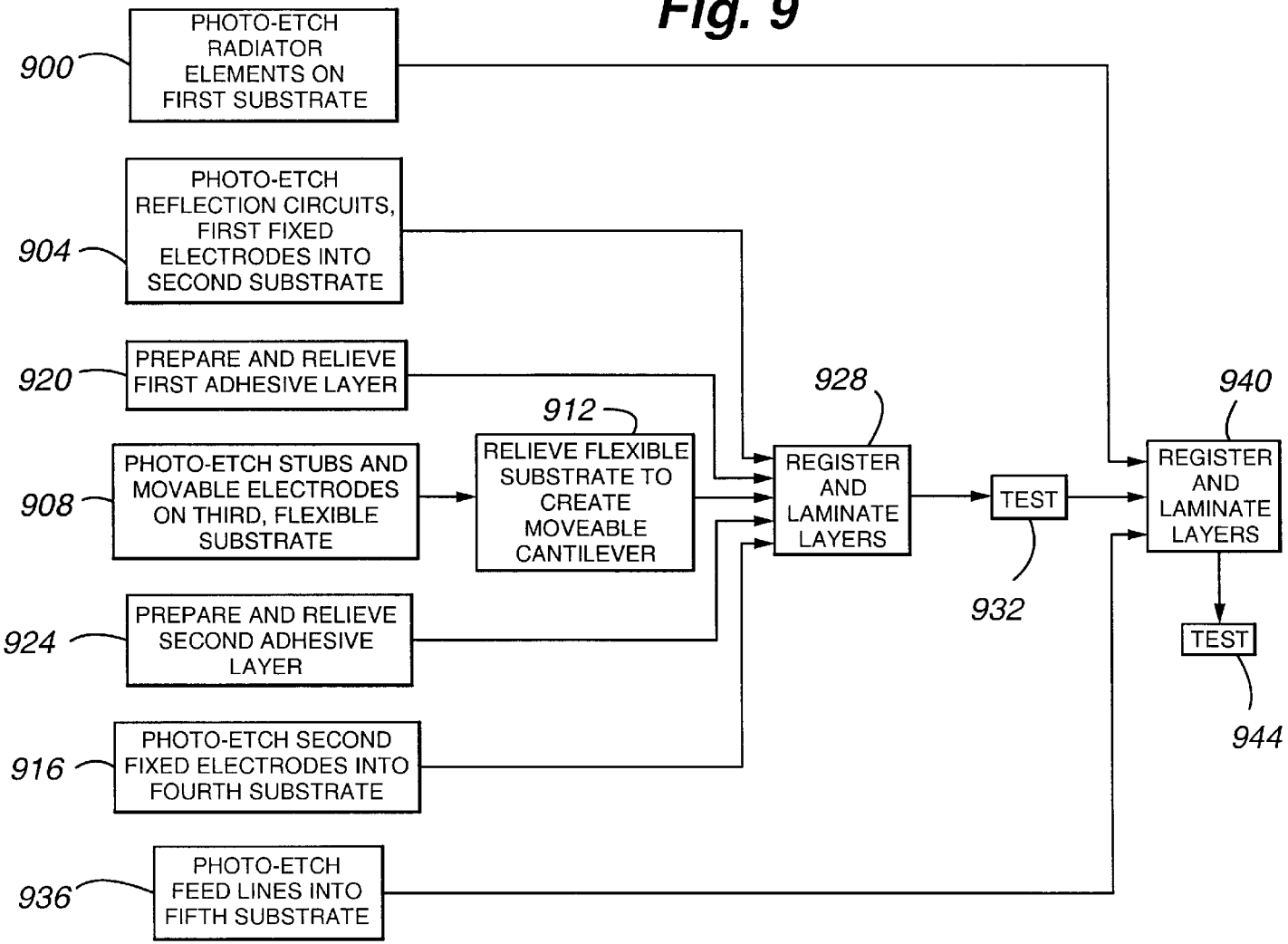
FIG. 9 is a flow diagram illustrating a method for producing an antenna array having an integrated configurable circuit in accordance with an embodiment of the present invention.

With reference now to FIG. 9, a flow diagram illustrating a method for producing an antenna and a plurality of configurable circuit elements 216 in accordance with an embodiment of the present invention, for example the embodiment illustrated in FIGS. 4A, 4B and 4C, is shown. In order to produce the aperture layer 200, individual radiator elements 108 are photo-etched on the first substrate 104 (step 900). Accordingly, a plurality of radiator elements 108 may be formed on the surface of the first substrate 104 in the same process step, simultaneously or at least substantially simultaneously. That is, each of the radiator elements 108 is formed during the same step or steps, and thus all are formed at about the same time. In connection with the aperture layer 200, holes for vias and registration pins may also be formed. The completed aperture layer 200 may, if it is formed from a flexible substrate 104 such as a polyimide, be stored in roll form before it is joined to a configurable circuit layer, as described below.

The first configurable circuit layer 300 is formed by photo-etching reflection circuits 228 and first stationary or fixed electrodes 224*a* on the substrate 400 (referred to as the second substrate in FIG. 9) (step 904). Following the formation of the reflection circuits 228 and the stationary electrodes 224*a*, those structures are covered by a first insulator layer 402. The first insulator layer 402 is relieved in the area of the stationary stubs of the reflection circuits 228 if the configurable circuit elements 216 of the configurable circuit layer 204 are to implement direct contact switches (for example as illustrated in FIGS. 5A and 5B). In connection with the formation of the first layer 300, vias 248 extending from the reflection circuits 228 to a surface of the substrate 400 opposite the reflection circuits 228 may also be formed. If the substrate 400 is flexible, the first layer 300 may be stored in roll form until it is joined to the other layers.

At step 908, moveable stubs 256 and moveable electrodes 320 are photo-etched on the substrate 404 (referred to as the third substrate in FIG. 9) of the second configurable circuit layer 304. The substrate 404 should be flexible, to allow for the moveable cantilevers 312 to resiliently move with respect to the remainder of the substrate 404. At step 912, the flexible substrate 404 is relieved to form slots 308 that define the moveable cantilevers 312. The slots 308 may be formed along three sides of a substantially rectangular cantilever 312, and may also be formed along a substantial portion of a fourth side of a substantially rectangular cantilever 312, such as is illustrated in FIGS. 3A and 3B. In addition, the slots 308 need not be formed in straight lines. For example, the moveable cantilever may be defined using one or more arcuate slots 308. The step of relieving the substrate 404 may include incising the substrate 404 by die cutting the substrate 404, or by cutting the substrate 404 using a laser or a knife. Alternatively, the step of relieving may include molding the substrate 404 such that slots 308 defining the moveable cantilevers 312 are formed when the flexible substrate 404 is itself formed. Accordingly, the moveable cantilevers 312 are formed at the same time (such as when the incisions are formed by die cutting the substrate 404 or during the step of molding the substrate 404) or at substantially the same time (such as when a laser or knife is used to create the incisions during the same process step). The completed second layer 304 may be stored in roll form until it is joined to the other layers.

At step 916, the second fixed electrodes 224*b* are photo-etched on the substrate 414 of the third configurable circuit layer 316. Accordingly, it can be appreciated that the second stationary electrodes 224*b* are formed at substantially the same time. An insulator layer 414 may then be formed over the second fixed electrodes 224*b*. If the substrate 412 (referred to as the fourth substrate in FIG. 9) is formed from a flexible material, such as a polyimide, the third layer 316 may be stored in roll form before it is registered with the other layers.

At step 920, the first spacer or adhesive layer 416 is prepared. The preparation of the first adhesive layer 416 includes forming a piece of adhesive in the correct size, such as by cutting a planar piece of adhesive to the correct size. In addition, preparing the adhesive layer 416 includes relieving the adhesive layer in those areas that are adjacent to the moveable cantilevers 312 when the first adhesive layer 416 is properly registered with the second layer 304. Similarly, at step 924, the second spacer or adhesive layer 420 is prepared. The preparation of the second adhesive layer 420 also includes relieving that layer in areas that will be adjacent to the moveable cantilevers 312 when the second adhesive layer 420 is registered with the second layer 304. In general, it can be appreciated that the first 416 and second 420 adhesive layers function as spacers between the first 300 and second 304 layers, and between the second 304 and third 316 layers. In addition, the first 416 and second 420 adhesive layers maintain the registration of the interconnected layers (layers 300, 304, and 316) 204 in the completed device. Furthermore, it can be appreciated that, although the moveable cantilever 312 may not be positioned adjacent to the third layer 316 (i.e. in a third position) it is desirable to relieve the. spacer or adhesive layer 420 in areas adjacent to both sides of the moveable cantilevers 312 to ensure that the moveable cantilevers 312 do not become adhered to the adhesive 420 and thus become incapable of moving from the first position to the second position. The adhesive layers 416 and 420 can be stored in roll form until they are registered with the other layers.

At step 928, the first layer 300, the first adhesive layer 416, the second layer 304, the second adhesive layer 420, and the third layer 316 are registered and laminated. In general, the registration of the layers comprises aligning the layers such that components formed on one of the layers are in proper alignment with components formed on an adjacent layer. Furthermore, the layers are aligned such that operative electrical connections can be made between the components as required. Pins may be placed in corresponding holes formed in the layers 300, 304 and 316 to assist in properly registering the layers 300, 304 and 316 with one another. The various layers are laminated together, such as by activating the adhesive of the first 416 and second 420 adhesive layers, to ensure that the proper registration of the layers is maintained. After the layers have been registered and laminated, the configurable circuit elements 216 are complete. The configurable circuit elements 216 are tested to ensure their proper operation (step 932). From the above description, it can be appreciated that by laminating the first 300 and third 316 layers on either side of the second layer 304,. the moving parts of the configurable circuit elements 216 (i.e. the moveable cantilevers 312) are sealed from the external environment. Therefore, additional packaging is not required to ensure that the configurable circuit elements 216 remain sealed from the external environment.

At step 936, the feed network 244 is photo-etched on the feed layer substrate 212 (referred to as the fifth substrate in FIG. 9) to form the feed layer 208. Accordingly, it can be appreciated that the feed lines 264 of the feed network 244 are formed at substantially the same time during the printing process. If the substrate 212 used in connection with the feed layer 208 is flexible, the completed feed layer 208 may be stored in roll.

At step 940, the configurable circuit elements 216 completed after registration and lamination of the component layers (step 928) and testing (step 932) are registered with the aperture layer 200 formed at step 900, and the feed layer 208 formed at step 936. The registration of these layers comprises aligning the layers so that the respective components may interconnect or properly align with corresponding components on the adjacent layer. Also at step 940, the aperture layer 200 is laminated to a layer of the configurable circuits (e.g., the first layer 300) and the feed layer 208 is laminated to a layer of the configurable circuits (e.g., the third layer 316) to ensure that the various layers maintain the proper relationship with one another. The step of registration may be assisted by the use of alignment pins positioned in corresponding holes. Upon the registration and lamination of the layers at step 940, the completed phased array antenna with integrated configurable circuit elements 100 is formed. The completed antenna 100 may then be tested (step 944) before it is placed in service. From the above description, it can be appreciated that the configurable circuit elements 216 are formed substantially simultaneously, upon the registration and lamination of the component layers 300, 304 and 316. In addition, it can be appreciated that the configurable circuit elements 216 are formed without requiring the picking and placing of individual components.

It should be appreciated that variations to the method for producing an antenna and a plurality of configurable circuit elements described above in connection with FIG. 9 are possible. For example, in connection with an embodiment such as the one illustrated in FIGS. 6A, 6B, 6C, 7A, 7B and 7C, separate substrates for the radiator elements 108 and feed lines 244 are not employed, therefore steps 900, 936, 940 and 944 may be eliminated. Instead, the radiator elements 108 may be formed on the second substrate, while the feed network 244 may be formed on the fourth substrate 412. Furthermore, and in particular in connection with an embodiment such as the one illustrated in FIGS. 7A, 7B and 7C, the formation of the reflection circuits 252, first fixed electrodes 224*a*, feed lines 264 and radiator elements 108 may be performed in a single step, for example, step 904. In addition, it should be appreciated that the present invention may be used in connection with providing a configurable circuit that may be used in connection with devices other than an antenna. Furthermore, the method of the present invention includes forming a single configurable circuit element. Also, the method of the present invention allows multiple or single circuit elements to be formed with or without radiator elements and feed networks.

The various steps of photo etching (e.g, steps 900, 904, 908, 916 and 936) may be performed;using alternative printed circuit board manufacturing techniques. For example, conductive elements may be screen printed and fired into substrates that are formed from an alumina ceramic. Furthermore, it should be appreciated that the described steps of photo etching may comprise various processes. For example, subtractive processes may be used, including printing a desired pattern on top of a metallized layer formed on a substrate and removing areas of the metallized layer not protected by a mask formed in connection with the printed pattern. Components may also be formed by mechanically removing areas of a metallized layer, such as by milling. Additive processes may also be used. For example, patterns of metallization may be printed on the surface of a substrate. As a further example, chemical vapor deposition techniques may be used. However, it should be noted that chemical vapor deposition techniques used in connection with the present invention are performed on substrates suitable for use in connection with printed circuits, as opposed to substrates formed from silicon wafers that may be doped and used in connection with semiconductor devices.

From the above description, it can be appreciated that a plurality of configurable circuit elements may be formed from components that are created substantially simultaneously. Furthermore, the completed configurable circuit elements may be formed substantially simultaneously when the various layers containing the component parts of the configurable circuit elements are registered with one another and joined together. Accordingly, the configurable circuit elements, and complete antenna assemblies, may be formed economically, without requiring the placement and interconnection of individual components. Furthermore, because conventional printed circuit board techniques are utilized, antennas formed in accordance with the present invention can easily be constructed in widths as large as 24" using commonly available materials and typically at least the first and second layers 300, 304 have a starting area of at least about 144 square inches when components are being formed associated therewith. Antennas in accordance with the present invention in even wider sheets can also be formed economically, provided that appropriate materials and equipment are available.

In accordance with an embodiment of the present invention, a phased array antenna assembly having low insertion loss characteristics is provided. For example, a radio frequency signal may be phase shifted by up to about 315°, while experiencing an insertion loss of 1.7 dB or less. In accordance with a further embodiment of the present invention, the maximum insertion loss for a 3 bit phase shifter assembly is 1.5 dB or less.

In addition to the excellent insertion loss performance of the present invention, the configurable circuit element 216 design of the present invention provides complete isolation between the radio frequency and DC bias components. Accordingly, filters, which can be expensive to implement and can cause insertion losses, are not necessary. In addition, configurable circuit elements 216 in accordance with the present invention are therefore suitable for use in connection with radio frequency transmission lines, such as striplines and micro striplines, and may function as switches.

In accordance with one embodiment of the present invention, the substrate 400 of the first layer 300 and the substrate 412 of the third layer 316 of the configurable circuit layer 208 are formed from an alumina ceramic. The conductive components, such as first stationary electrodes 224*a* and reflection circuits 228 (in connection with the first layer 300), and second stationary electrodes 224*b* (in connection with the third layer 316) are formed by metalization. The flexible substrate 404 of the second layer 304 of the configurable circuit layer 204 is formed from a polyimide film. The electrically conductive components of the second layer 204, such as the moveable electrodes 320 and the moveable stubs 256 are formed using metalization and microlithography. With respect to each of the layers, polyxylxylene dielectric coatings may be applied using chemical vapor deposition to provide electrical insulation. For example, the first 402 and second 414 insulator layers may be so formed. The spacer or adhesive layers 416 and 420 may be formed from thin, pressure sensitive or thermoplastic films, and vacuum lamination may be used in connection with the adhesive layers 416 and 420. Then pressure sensitive or thermo-plastic films may, in addition to joining the layers 300, 304 and 316 of the phase shifter layer 204, may be used to laminate the aperture layer 200 to the phase shifter layer 204, and to laminate the configurable circuit layer 204 to the combiner layer 208.

In accordance with an embodiment of the present invention, the polyimide used to form the flexible substrate 404 is 0.001" thick. Furthermore, the spacers 416 and 420 are 0.001" thick, to form about a 0.001" thick gap between the moveable stubs 256 and the stationary stubs 252 when the moveable cantilever 312 is in a first position. The substrates 104, 264, 400, and 412 may be 0.005" thick. The first 402 and second 414 insulator layers may be about 0.0003" thick.

According to one embodiment, a phased array antenna having integrated configurable circuit elements in accordance with the present invention includes an array of 256 radiator elements 108, each of which are 0.4" by 0.4". Furthermore, the configurable circuit elements 216 associated with each of the radiator elements 108 are capable of introducing a phase shift of from 0° to 315° in connection with an input (or received) signal having a frequency of 10 GHz. The maximum insertion loss of a signal through any one of the configurable circuit elements 216 is about 1.5 dB.

Although the foregoing description has been in terms of configurable circuit elements 216 that provide radio frequency phase shifters in connection with a 90° hybrid transmission line reflection circuit, the present invention is not so limited. For instance, the present invention may be used to provide a configurable circuit comprised of component layers that provides a plurality of switches or variable capacitors. As an example, the present invention may provide a plurality of switches suitable for use in connection with the transmission of radio frequency signals. As a further example, the present invention may provide a plurality of configurable circuits that each provide a variable capacitance in connection with associated radio frequency transmission lines. An embodiment providing a configurable circuit element 216 that implements a direct contact switch or variable capacitor may comprise a radio frequency input as a first component, and a radio frequency output associated with a moveable cantilever as a second component. With respect to a direct contact switch, the switch is on when the moveable cantilever of the configurable circuit element places the radio frequency input in contact with the radio frequency output. With respect to a variable capacitor, the capacitance of the configurable circuit element is relatively high when then moveable cantilever is positioned to place the radio frequency output in close proximity to the radio frequency input, and is relatively low when the moveable cantilever is positioned so that the output is distal from the input. Furthermore, the switches or variable capacitors may be used to selectively interconnect corresponding radio frequency transmission lines to delay lines, attenuators, amplifiers, or other electrical devices.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

What is claimed is:

1. A method for producing a configurable circuit comprising:

forming at least a first component of said configurable circuit on a planar first material;

forming at least a second component of said configurable circuit on a planar second material, wherein said planar second material is flexible;

relieving said planar second material, wherein at least a first moveable cantilever is formed;

registering said first planar material with said second planar material, wherein said at least a first component is placed in a defined relationship with said at least a second component; and interconnecting said first and second planar materials, wherein said configurable circuit is formed, and wherein said steps of forming at least a first component and of forming at least a second component comprise using printed circuit board manufacturing techniques.

2. The method of claim 1, wherein said step of forming at least a second component on said planar second material comprises relieving said planar second material on three sides of said moveable cantilever.

3. The method of claim 1, wherein said printed circuit board manufacturing techniques comprise at least one of additive processes and subtractive processes.

4. The method of claim 1, wherein said printed circuit board manufacturing techniques comprise steps of patterning, etching and cleaning.

5. The method of claim 1, wherein multiple of said a least a first component of said configurable circuit are formed at substantially a first time, and wherein multiple of said at least a second component of said configurable circuit are formed at substantially a second time.

6. The method of claim 1, wherein said steps of forming said at least a first component and of forming said at least a second component are conducted independently of selecting and placing individual components on said first or second materials.

7. The method of claim 1, wherein said at least a first component of said configurable circuit comprises at least one of a radio frequency input, a radio frequency output, and a fixed electrode.

8. The method of claim 1, wherein said at least a second component of said configurable circuit comprises at least a first moveable circuit member and at least a first moveable electrode.

9. The method of claim 1, wherein said configurable circuit forms at least a portion of a phase shifter.

10. The method of claim 1, wherein said configurable circuit forms at least a portion of an attenuator.

11. The method of claim 1, wherein each of said planar first material and said planar second material has an area of greater than about 144 square inches.

12. The method of claim 1, wherein said step of interconnecting comprises shaping a spacer layer and interposing said spacer layer between said first and second planar materials.

13. The method of claim 12, wherein said spacer layer comprises an adhesive.

14. The method of claim 1, further comprising forming at least a third component of said configurable circuit on a planar third material, wherein said step of registering comprises registering said first, second and third planar materials, wherein said at least a first component is placed in a defined relationship with said at least a second component, and wherein said at least a third component is placed in a defined relationship with said at least a second component.

15. The method of claim 14, wherein said at least a third component of said configurable circuit comprises a fixed electrode.

16. The method of claim 1, further comprising forming at least a first antenna radiator element on a substrate wherein said at least a first component is placed in a defined relationship with said at least a first radiator element.

17. The method of claim 14, further comprising forming at least a first feed line on a substrate, wherein said at least a first component is placed in a defined relationship with said at least a first feed line.

18. The method of claim 1, further comprising forming an insulator layer over at least portions of said at least a first component.

19. The method claim 1, wherein said configurable circuit comprises at least a first variable capacitor.

20. The method of claim 1, wherein said configurable circuit comprises at least a first switch.

21. The method of claim 1, wherein said configurable circuit comprises at least a first radio frequency phase shifter.

22. The method of claim 1, wherein said configurable circuit comprises at least a first radio frequency attenuator.

23. The method of claim 1, wherein said configurable circuit implements a radio frequency transmission line circuit.

24. The method of claim 1, wherein said planar first material and said planar second material comprise flexible dielectric materials.

25. A method for forming an antenna having a plurality of radiator elements and a plurality of configurable circuit assemblies, comprising:

a) forming multiple at least first components of said plurality of configurable circuit assemblies on a planar first material, wherein said step of forming at least first components comprises:

i) applying printed circuit board manufacturing techniques;

b) forming multiple at least second components of said configurable circuit assemblies on a flexible second material, wherein said step of forming said.at least second components comprises:

i) applying printed circuit board manufacturing techniques to form a plurality of conductive elements; and ii) relieving said flexible second material to form a plurality of moveable cantilevers;

c) forming a plurality of said radiator elements on at least one of said planar first material and a planar third material, wherein said.step of forming a plurality of radiator elements comprises:

i) applying printed circuit board manufacturing techniques;

d) registering at least said first and said second materials, wherein each of said at least first components is placed in a defined relationship with each of said at least second components; and e) interconnecting at least said first and second materials.

26. The method of claim 25, wherein said plurality of radiator elements are formed on a planar third material, said method further comprising:

f) registering said planar third material with one of said first and second planar materials; and g) forming a plurality of vias electrically interconnecting each of said plurality of radiator elements to a corresponding one of said at least first components.

27. The method of claim 25 further comprising:

f) forming multiple at least third components of said plurality of configurable circuit assemblies on a planar fourth material, wherein said step of forming at least third components of said plurality of configurable circuit assemblies comprises:

i) applying printed circuit board techniques;

g) registering said second and fourth materials, wherein each of said at least second components is placed in a defined relationship with said at least third components; and h) interconnecting said second and fourth materials.

28. The method of claim 25, wherein said step of interconnecting said first and second materials comprises:

i) preparing a spacer layer;

ii) relieving said spacer layer in selected areas;

iii) interposing said spacer layer between said first and second materials;

iv) registering said spacer layer with said first and second materials, wherein said relieved areas of said spacer layer are aligned with said plurality of moveable cantilevers;

v) attaching said second material to said spacer layer; and vi) attaching said third material to said spacer layer.

29. The method of claim 28, wherein said spacer layer comprises an adhesive.

30. The method of claim 25, wherein said first, second and third materials comprise flexible dielectric materials.

31. The method of claim 25, wherein said printed circuit board manufacturing techniques comprise steps of patterning, etching and cleaning.

32. The method of claim 25, wherein said multiple first components of said plurality of configurable circuit assemblies are all formed at substantially a first time, and wherein said multiple second components of said plurality of configurable circuit assemblies are all formed at substantially a second time.

33. The method of claim 25, wherein said steps of forming at least first components and of forming said at least second components does not include picking and placing components on said first or second materials.

34. The method of claim 25, wherein said step of forming multiple at least first components of said plurality of configurable circuit assemblies on a planar first material further comprises:

ii) forming an insulator layer over at least portions of said at least first components.

35. The method of claim 27, wherein said step of forming multiple at least third components of said plurality of configurable circuit assemblies on a planar fourth material further comprises:

ii) forming an insulator layer over at least portions of said at least third components.

36. The method of claim 25, wherein said configurable circuit assemblies comprise a radio frequency transmission line circuit.

37. The method of claim 25, wherein said plurality of configurable circuit assemblies comprise a plurality of variable capacitors.

38. The method of claim 25, wherein said plurality of configurable circuit assemblies comprise a plurality of switches.

39. The method of claim 25, wherein said plurality of configurable circuit assemblies comprise a plurality of radio frequency phase shifter assemblies.

40. The method of claim 25, wherein said plurality of configurable circuit assemblies comprise a plurality of attenuator assemblies.

41. The method of claim 25, wherein said plurality of configurable circuit assemblies are formed substantially simultaneously.

42. An antenna apparatus, comprising:

a plurality of radiator elements;

a plurality of radio frequency circuits located in a first plane, wherein at least a one of said radiator elements is interconnected to at least a one of said radio frequency circuits by a conductor;

a plurality of fixed electrodes located in said first plane;

a flexible dielectric substrate;

a plurality of moveable cantilevers formed in said flexible dielectric substrate;

a plurality of moveable electrodes, wherein at least a portion of at least one of said moveable electrodes is formed on a one of said plurality of moveable cantilevers; and a plurality of moveable radio frequency circuit members, wherein at least a portion of at least a one of said moveable radio frequency circuit members is formed on a one of said plurality of moveable cantilevers, wherein a voltage differential applied between at least a one of said fixed electrodes and at least a one of said moveable electrodes moves a moveable cantilever on which at least a portion of said at least a one moveable electrode is formed, wherein a distance between at least a one of said moveable radio frequency circuit members and at least a one of said radio frequency circuits is altered, whereby at least one of an amplitude and a phase delay of a radio frequency signal passing through said at least a one of said radio frequency circuits is altered.

43. The antenna of claim 42, wherein said moveable radio frequency circuit members are not electrically interconnected to said moveable electrodes.

44. The antenna of claim 42, wherein said plurality of radiator elements are located in said first plane.

45. The antenna of claim 42, wherein said plurality of radiator elements are located in a second plane, wherein each of said radiator elements is electrically interconnected to one of said plurality of radio frequency circuits by a via.

46. The antenna of claim 42, further comprising radio frequency feed circuitry electrically interconnected to said plurality of radio frequency circuits.

47. The antenna of claim 46, wherein said radio frequency feed circuitry is located in a third plane, and wherein said radio frequency feed circuitry is electrically interconnected to said plurality of radio frequency circuits by a plurality of vias.

48. The antenna of claim 42, wherein said antenna apparatus is flexible.

49. The antenna of claim 42, wherein said applied voltage differential causes at least a one of said moveable radio frequency circuit members to come into contact with at least a one of said radio frequency circuits.

50. The antenna of claim 42, further comprising a first insulator layer interposed between said plurality of fixed electrodes and said plurality of moveable electrodes.

51. The antenna of claim 42, wherein said radio frequency circuits comprise a radio frequency input line comprising at least a first radio frequency transmission line.

52. An antenna having a plurality of integrated configurable radio frequency circuit assemblies, comprising:

a) a first substrate, wherein said first substrate is a dielectric;

b) a plurality of conductive traces formed on said first substrate, wherein said conductive traces formed on said first substrate comprise a plurality of radio frequency inputs, a plurality of radio frequency outputs, radio frequency circuit and a plurality of first stationary electrodes;

c) a second substrate, wherein said second substrate is a dielectric and wherein said second substrate is flexible;

d) a plurality of moveable cantilevers formed in said second substrate;

e) a first spacer interposed between at least a portion of said first substrate and said second substrate, wherein said first spacer is relieved in a plurality of areas corresponding to said plurality of moveable cantilevers; and f) a plurality of conductive traces formed on said second substrate, wherein said conductive traces formed on said second substrate comprise moveable radio frequency circuit members and moveable electrodes, and wherein at least a portion of one moveable radio frequency circuit member and at least a portion of one moveable electrode is formed on each of said plurality of moveable cantilevers, wherein at least a portion of one of said moveable electrodes is adjacent at least a portion of one of said first stationary electrodes, wherein a voltage may be selectively applied to said at least one of said first stationary electrodes to move said one moveable electrode towards said first stationary electrode, and wherein at least one moveable radio frequency circuit member, at least a portion of which is formed on a cantilever on which at least a portion of said moveable electrode is formed, is moved with respect to a corresponding radio frequency circuit.

53. The antenna of claim 52, further comprising:

a plurality of radiator elements, wherein each of said radiator elements is electrically interconnected to a corresponding one of said plurality of radio frequency outputs.

54. The antenna of claim 53, wherein said plurality of radiator elements are formed on said first substrate.

55. The antenna of claim 53, wherein said plurality of radiator elements are formed on a second substrate.

56. The antenna of claim 52, further comprising g) a third substrate, wherein said third substrate is a dielectric; and h) a plurality of conductive traces formed on said third substrate, wherein said conductive traces formed on said third substrate comprise a plurality of second stationary electrodes, wherein at least a portion of a one of said moveable electrodes is interposed between said at least a portion of a one of said first stationary electrodes and at least a portion of a one of said second stationary electrodes, wherein a voltage may be selectively applied to at least one of said one first stationary electrode and said one second stationary electrode to move said one moveable electrode towards a one of said first stationary electrode and said second stationary electrode, wherein said at least a one moveable radio frequency circuit member, at least a portion of which is formed on a cantilever on which at least a portion of said moveable electrode is formed, is moved with respect to said corresponding radio frequency circuit.

57. The antenna of claim 56, further comprising a second spacer interposed between at least a portion of said second substrate and said third substrate, wherein said second spacer is relieved in a plurality of areas adjacent to said plurality of moveable cantilevers.

58. The antenna of claim 56, further comprising a plurality of conductive traces, wherein said conductive traces comprise a plurality of feed lines, and wherein at least a one of said plurality of radio frequency inputs is interconnected to at least a one of said plurality of feed lines.

59. The antenna of claim 52, wherein said selectively applied voltage places said at least one moveable radio frequency circuit member in contact with said corresponding radio frequency circuit.

60. The antenna of claim 52, further comprising:

a first insulator layer interposed between at least a portion of said plurality of conductive traces formed on said first substrate and said first spacer.

61. The antenna of claim 57, further comprising:

a first insulator layer interposed between at least a portion of said plurality of conductive traces formed on said first substrate and said first spacer; and a second insulator layer interposed between at least a portion of said plurality of conductive traces-formed on said third substrate, and: said second spacer.

62. The antenna of claim 52, wherein said plurality of radio frequency inputs comprise at least a first radio frequency transmission line.

63. The antenna of claim 62, wherein said at least a first radio frequency transmission line comprises a microstrip line.

64. The antenna of claim 62, wherein said at least a first radio frequency transmission line comprises a stripline.

65. The antenna of claim 52, wherein said configurable radio frequency assemblies comprise at least one of a phase shifter, a radio frequency attenuator, and a switch.

* * * * *